US005555683A

United States Patent [19]

Schroeder

[11] Patent Number: 5,555,683

[45] Date of Patent: Sep. 17, 1996

[54] APPARATUS AND METHOD FOR OPENING AND CLOSING SKYLIGHTS

[76] Inventor: Arthur G. Schroeder, 3046 Lees Ave., Long Beach, Calif. 90808

[21] Appl. No.: 326,665

[22] Filed: Oct. 19, 1994

[51] Int. Cl.[6] ..... E04B 7/18

[52] U.S. Cl. ..... 52/200; 52/72

[58] Field of Search ..... 52/66, 72, 200; 160/99, 100, 102

[56] References Cited

U.S. PATENT DOCUMENTS

| | | | |
|---|---|---|---|
| 3,277,619 | 10/1966 | Miller et al. | 57/72 |
| 3,815,299 | 6/1974 | Sörenson | 52/66 |
| 4,762,160 | 8/1988 | Bechtold et al. | 52/200 X |
| 5,088,543 | 2/1992 | Bilbrey | 52/200 X |
| 5,392,564 | 2/1995 | Fechter et al. | 52/200 X |

*Primary Examiner*—Creighton Smith
*Attorney, Agent, or Firm*—F. Eugene Logan

[57] ABSTRACT

An apparatus for covering and uncovering a skylight opening. The apparatus has a parallel guide pair mounted on the outside of a framing surrounding the opening, a carriage with skylight movably mounted on the guides, and an actuator for moving the carriage over the guide's length. The guides extend a distance beyond the framing's right side sufficient to displace the skylight completely away from the opening. One end of a screen, large enough to cover the opening, is connected to the carriage's left side. The other screen end is mounted on a storage roller rotatably supported by the framing's left side. The roller's spring maintains screen tension so that, when the carriage is displaced away from the framing's left side, the screen is tautly pulled over the space between the framing's left side and the carriage's left side. One end of a shade, large enough to cover the carriage's opening, is positionable adjacent the carriage's left inside wall. The other shade end is mounted on a second storage roller rotatably supported by the framing's right side. The roller's spring maintains shade tension. A coupling device's left end is attached to the shade's one end. The device's right end can be coupled and uncoupled to the carriage's right side. When the device is coupled, that part of the carriage overlaying the framing's opening is covered by the shade. A rigid panel shade can also be used with the coupling device. The carriage can be remotely opened and closed and automated to open for smoke, and to close for moisture and intruders.

34 Claims, 35 Drawing Sheets

APPARATUS AND METHOD FOR OPENING AND CLOSING SKYLIGHTS

BACKGROUND OF THE INVENTION

Skylights that can open are known. The most commonly used skylights which can be open are hinged and permit one side of the skylight to be pivoted upwards about 9 inches or less. U.S. Pat. No. 3,465,483, however, permits the skylight to be moved off the opening in the roof sing an electric motor mounted on, and moving with, the skylight.

SUMMARY OF THE INVENTION

This invention is directed towards an apparatus for retrofitting existing installed Skylights, or installation with new skylights, so that the skylight can be completely displaced away from the skylight opening in the roof. This invention can be used also for windows or other openings in structures including but not limited to office buildings, homes and auditoriums, and for openings in flat, sloping or vertical roofs or walls. This invention is not limited to retrofitting existing installed skylights but can be used wit completely new installations of skylights and windows.

Accordingly, there is provided by the principles of this invention an apparatus for covering and uncovering an opening in a structure comprising a framing having front, rear, left and right side members with an opening therethrough which spans an opening in a structure. The apparatus comprises a pair of parallel guides each having a left end, a right end and a length. One of the guide is mounted on the outside surface of the front side member of the framing and the other guide is mounted on the outside surface of the rear side member of the framing. The left end of each of the parallel guides is mounted near the left side member of the framing and the right end of each of the guides extends beyond the right side member of the framing a predetermined distance. A carriage means is movably mounted on the parallel guides so that the carriage means can be moved over the length of the parallel guides. The carriage means has an opening therethrough preferably about the same size as the opening through the framing. The apparatus also comprises means for moving the carriage means over the length of the parallel guides.

The carriage means is adaptable for mounting a cover member on the top thereof. In one embodiment, the apparatus comprises a cover member mounted on the carriage means, and in a further embodiment, the cover member is a skylight.

In one embodiment, the apparatus also comprises a flexible screen with a size large enough to cover the opening through the framing, and screen storage means for rolling the screen onto for storage. The screen has one end thereof connected to the left side of the carriage means and the other end thereof mounted on the screen storage means. The screen storage means is rotatably supported by a stationary member at a location on or near and outside of the left side member of the framing. The apparatus also comprises means for maintaining the screen in tension so that, when the carriage means is displaced away from the left side member of the framing, the screen will be unrolled from the screen storage means and tautly pulled over the space between the left side member of the framing and the left side of the carriage means.

In a further embodiment, means is provided for aligning the screen to the framing as the screen is tautly pulled over the space between the left side member of the framing and the left side of the carriage means.

In another embodiment, a shade having a size large enough to cover the opening through the carriage means, and shade storage means for storing the shade away from the opening through the framing, are provided. This embodiment includes means for linking and unlinking the shade to the carriage means so that, when the shade is linked to the carriage means, that part of the opening through the carriage mean between the left end of the opening through the carriage means and the right side member of the framing will be covered by the shade.

In another embodiment, the apparatus further comprises a flexible shade having a size large enough to cover the opening through the carriage means, and shade storage means for rolling the shade onto for storage. The shade storage means is rotatably supported by a stationary member at a location on or near and outside of the right side member of the framing. This embodiment includes means for linking ad unlinking one end of the shade to the carriage means so that, when said one end of the shade is linked to the carriage means, that part of the opening through the carriage mean between the left end of the opening through the carriage means and right side member of the framing is covered by the shade. This embodiment also has means for maintaining the shade in tension between the shade storage means and said one end of the shade so that, when said one end of the shade is linked to the carriage means, the shade will be unrolled from the shade storage means end tautly pulled over said part of the opening through the carriage mean.

In one embodiment, the means for moving the carriage means comprises a linear actuator having the housing of which is mounted to a stationary member and the telescoping member of which is connected to the carriage means. Preferably the housing is mounted to, and supported by, the framing.

In one embodiment, the apparatus further comprises means for automatically stopping the carriage means as it moves towards the left end of the parallel guides and completely covers the opening through the framing, and means for automatically stopping the carriage means as it moves towards and reaches a predetermined point near the right end of the parallel guides.

In still another embodiment, the apparatus further comprises controller means having a first control for moving the carriage means towards the left end of the parallel guides, and a second control for moving the carriage means towards the right end of the parallel guides. In one embodiment, the controller means is a remote controlled controller means, and in a further embodiment the remote control means is voice activated.

In another embodiment, the apparatus further comprises means for sensing smoke at a predetermined location inside the structure and, when smoke is sensed, for automatically moving the carriage means to a predetermined point near the right end of the parallel guides and away from the opening through the framing.

In still another embodiment, the apparatus further comprises means for sensing moisture at a predetermined location outside of the structure and, when moisture is sensed, for automatically moving the carriage means over the opening through the framing.

In yet another embodiment, the apparatus further comprises means for sensing motion at a predetermined location outside of the structure and, when motion is sensed, for automatically moving the carriage means over the opening through the framing.

There is also provided by the principles of this invention an apparatus for covering and uncovering an opening in a structure having the framing, the pair of parallel guides, the carriage means, and the means for moving the carriage means over the length of the parallel guides as broadly mentioned above. However, this embodiment is not required to have the flexible screen mentioned above. This embodiment does have the flexible shade, the shade storage means for rolling the shade onto for storage, the means for linking and unlinking one end of the shade to the carriage means, and the means for maintaining the shade in tension between the shade storage means and said one end of the shade mentioned above.

This embodiment can also have an elongated roller means, supported by a stationary member, positioned between the shade storage means and said one end of the shade. The elongated roller means is for aligning the shade over the right side member of the framing as the shade is extended thereover.

In another embodiment, the apparatus further comprises controller means having a first control for moving the carriage means towards the left end of the parallel guides, a second control for moving the carriage means towards the right end of the parallel guides, and a third control for activating and deactivating the means for linking and unlinking said one end of the shade to the carriage means. In one embodiment, the means for linking and unlinking said one end of the shade to the carriage means comprises a Spanner member with the left end thereof connected to said one end of the flexible shade, and means for coupling and uncoupling the right end of the spanner member to the right side of the carriage means. In this embodiment, when the spanner member is coupled to the right side of the carriage means, the left end of the spanner member is positioned near the left side of the opening through the carriage means.

In one embodiment, when the spanner member is coupled to the carriage means, the spanner member is between the flexible shade and the carriage means.

In another embodiment, the apparatus further comprises a cross member fixed to and spanning from front to rear the right end of the parallel guides. The means for coupling and uncoupling the right end of the spanner member to the right side of the carriage means comprises solenoid means and connector means having a first part and a second part. The solenoid means has a plunger and is supported by the cross member. The first part has a first-half connector link and is supported by the right distal end of the spanner member. The second part has a cam part and a second-half connector link and is pivotally connected to the right, side of the carriage means. In this embodiment when the plunger of solenoid means retracted the second-half connector link connects to the first half connector link when the carriage means reaches the solenoid means. Also in this embodiment when the first-half and second-half connector links are connected and the plunger of solenoid means is extended the extended plunger and cam part cause the second part to pivot away from the first-half connector link when the cam part reaches the solenoid means thereby disconnecting of the second-half connector link from the first-half connector link Also in this embodiment, when the first-half and second-half connector links are disconnected and the plunger of solenoid means is extended, the extended plunger and cam part cause the second part to pivot away from the first-half connector link when the cam part reaches the solenoid means thereby preventing the second-half connector link from connecting to the first-half connector link. A still further embodiment comprises controller means having a first control for moving the carriage means towards the left end of the parallel guides, a second control for moving the carriage means towards the right end of the parallel guides, and a third control for energizing the solenoid means In a related embodiment, instead of the flexible shade and its roll-up shade storage means, the apparatus comprises a rigid tray member having front, rear, left and right ends and an opening therebetween. The tray member has a size large enough to span the opening through the carriage means panel member fitted over the opening of, and encased by, the tray member This embodiment includes means for coupling and uncoupling the right side of the tray member to the right side of the carriage means so that, when the tray member is so coupled, the left side of the tray member is positioned near the left side of the opening through the carriage means, and the part of the opening through the framing covered by the carriage means is also covered by the tray member and panel member assembly.

In one embodiment, the opening through the tray member is a plurality of openings formed by a frame a work dependent from the tray member, and the panel member is a plurality of panels fitted over the plurality of openings in the frame work Another embodiment further comprises a cross member fixed to and spanning form front to rear the right the end of the parallel guides. In this embodiment the means for coupling and uncoupling the right side of the tray member to the right side of the carriage means comprise the solenoid means and the connector means having the first part and the second part mentioned above. The first part, however, is supported by the right end of the tray member rather than the spanner member as mentioned in the former embodiment.

There is also provided by the principles of this invention an apparatus for covering and uncovering an opening in a structure comprising the framing, the pair of parallel guides, the carriage means, and the means for moving the carriage means over the length of the parallel guides as mentioned above. In this embodiment, the means for moving the carriage means over the length of the parallel guides which comprises a linear actuator the housing of which is mounted to a stationary member and the telescoping member of which is connected to the carriage means. Preferably the stationary member is the framing.

In a further embodiment, the apparatus further comprises means for automatically stopping the carriage means as it moves towards the left end of the parallel guides and completely covers the opening through the framing, and means for automatically stopping the carriage means as it moves towards and reaches a predetermined point near the right end of the parallel guides.

In another embodiment, the apparatus further comprises an electrical power source for powering the linear actuator. In a further embodiment, the electrical power source is a battery, and in a still further embodiment, the apparatus includes a solar panel for charging the battery. In another embodiment, the power source is from wired electrical utility power.

In one embodiment of this invention no cables, pulleys, sprocket wheels or chains are required for the means for moving the carrier means. Thus rusting and pitting of such means is eliminated thereby providing a long life with little or no maintenance beyond periodic lubrication.

In this invention the motor is mounted on a stationary member and does not travel with the carrier means thereby eliminating hating hanging power cords and wearing thereof associated motors and power cords that travel with the carriage.

In another embodiment, means for remotely cleaning the transparent member of the skylight is provided.

DESCRIPTION OF THE PREFERRED EMBODIMENTS

Figure 1:
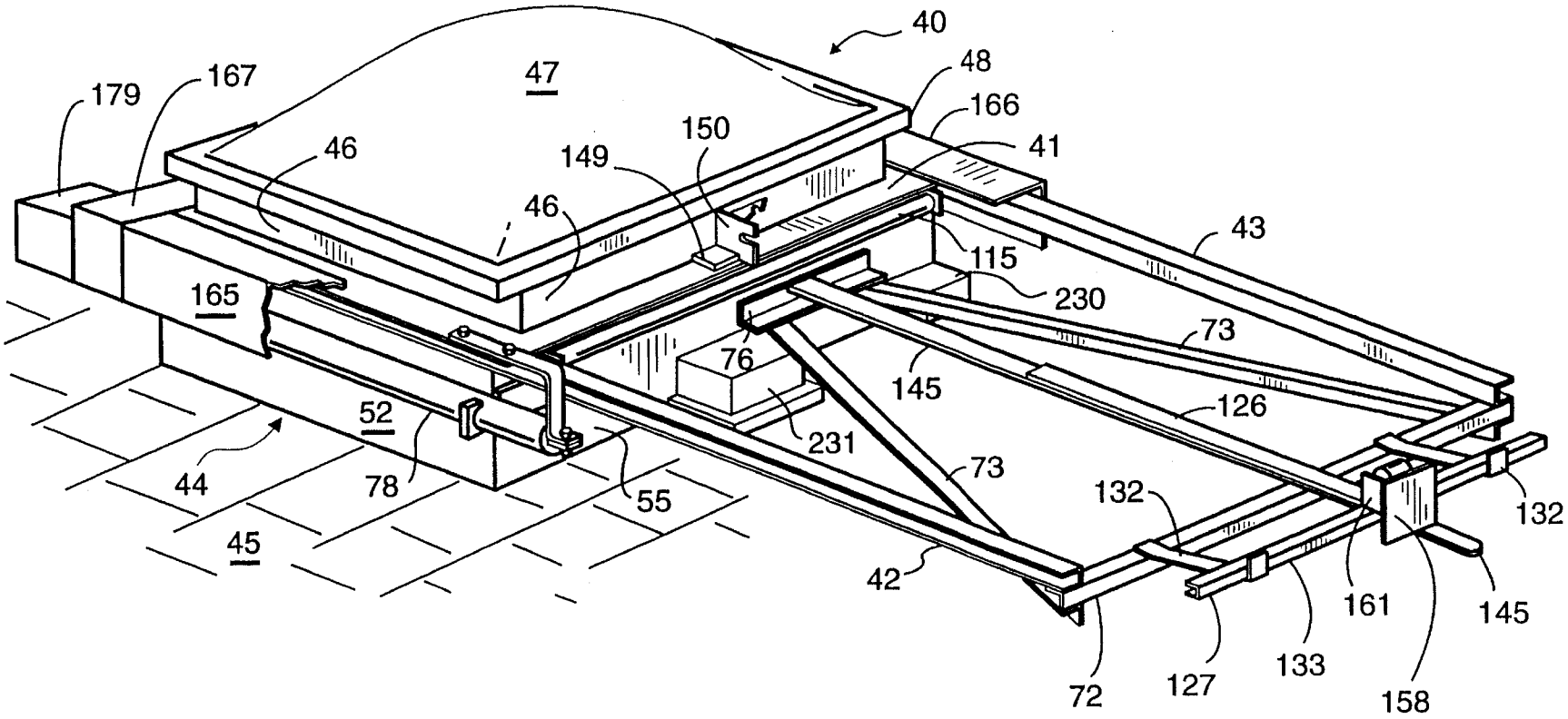
FIG. 1 is a top, front and right perspective view of a skylight and framing with the apparatus of this invention with the skylight covering the opening through the framing.

The term "lateral" as used herein pertains to a left direction defined by FIG. 1. The term "traverse" as used pertains to a front-rear direction defined by FIG. 1. With reference to the drawings, like characters are employed to designate like parts. With particular reference first to FIG. 1, a conventional skylight unit 40 with a horizontal flashing 41 which serves as a carriage means to this embodiment of this invention. The carriage means or horizontal flashing 41 is slideably mounted on a pair of parallel tracks 42 and 43. Tracks 42 and 47 are mounted on conventional curbing 44 which serves in this embodiment as a framing for supporting the apparatus of this invention. The curbing is attached to the root 45 of a building with conventional weather stripping.

Referring to FIGS. 1–7, a skylight of conventional design is shown having front, rear, left and right vertical members 46 mounted on horizontal flashing 41. The top of the skylight is covered by a transparent member 47 and secured to vertical members 46 in sealing relationship by encasement 48.

Figure 8:
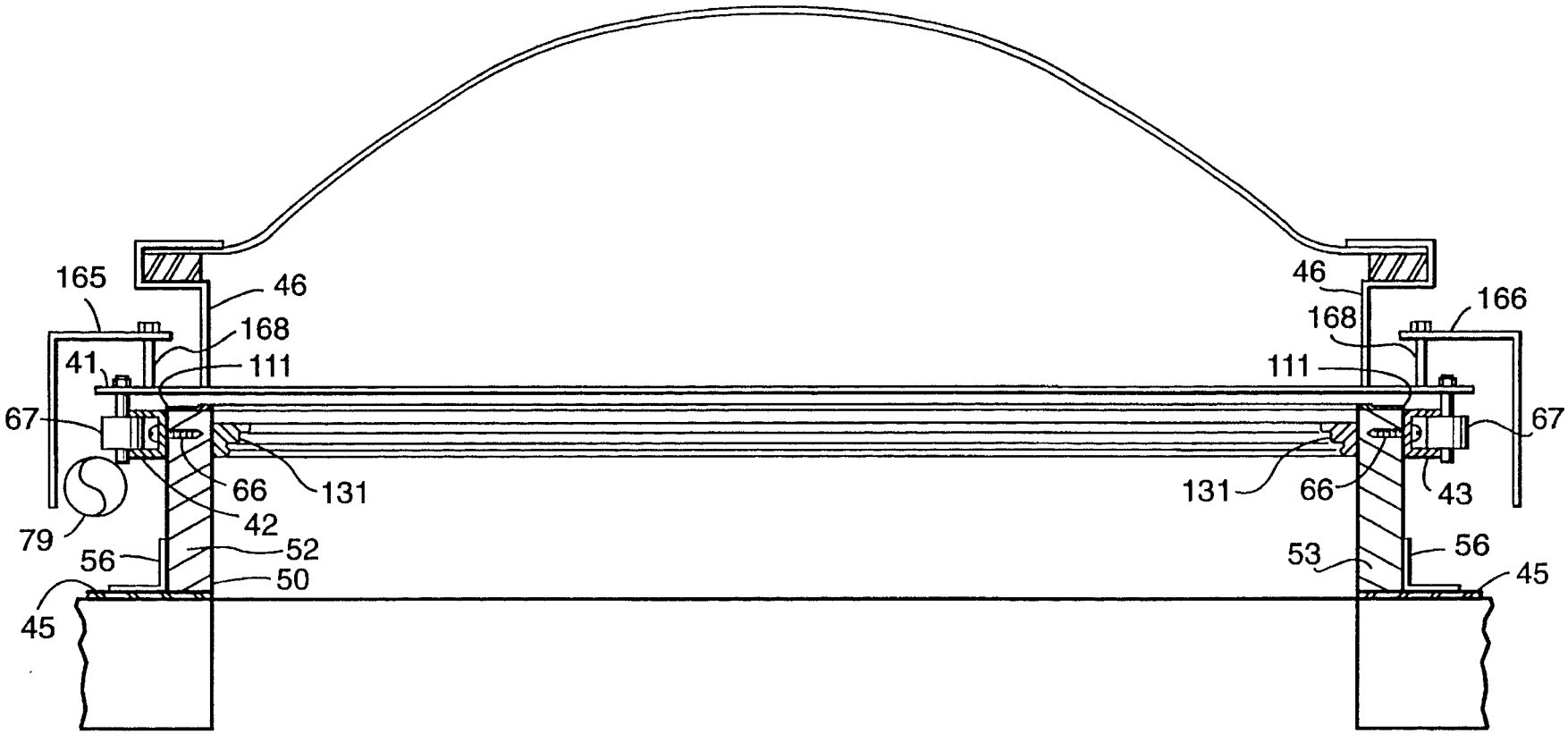
FIG. 8 is an enlarged elevational cross-sectional view taken through line 8—8 of FIG. 3 to show the carriage rollers in the parallel tracks and the flexible shade extended over the open through the skylight.

Curbing or framing 44, of conventional design, surrounds a skylight opening 50, see FIG. 8, through framing 44. The framing has front and rear vertical side members 52 and 53, respectively, and left and right vertical side members 54 and 55, respectively, and is fastened to the roof in a weather proof manner with flashing 56. Since the term curbing may not be usually used with skylights or similar devices affixed to walls, such supporting stationary structure will be referred herein as the "framing" rather than "curbing" to encompass its attachment to vertical walls as well as steeply sloped roofs.

In FIGS. 1–7, an existing skylight has been retrofitted according to the principles of this invention by inserting and installing the apparatus of this invention between the conventional skylight 40 and framing 44.

Figure 2:
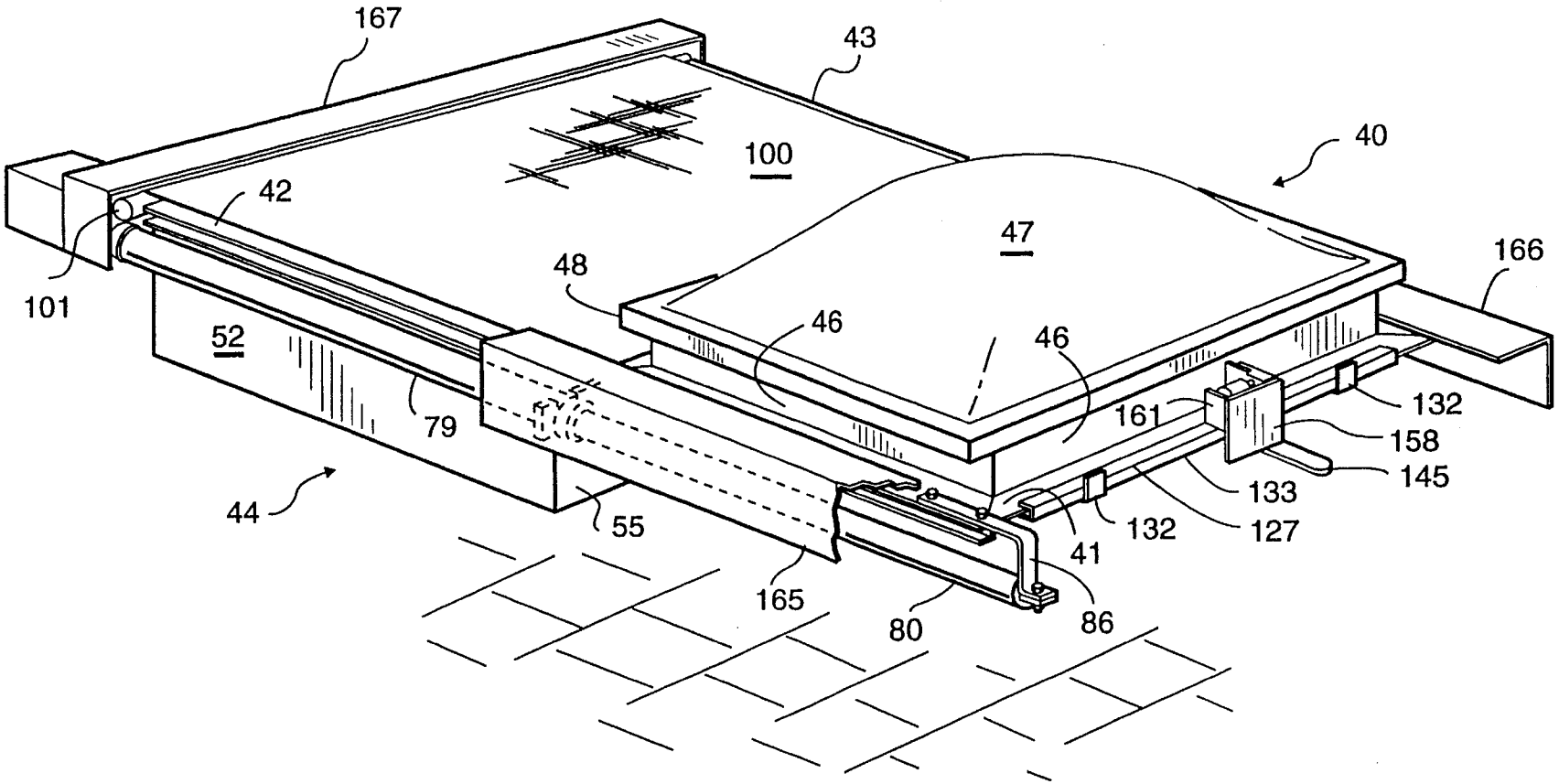
FIG. 2 is another top, front and right perspective view of the apparatus of FIG. 1 with the skylight displaced completely away from the opening through the framing.
Figure 3:
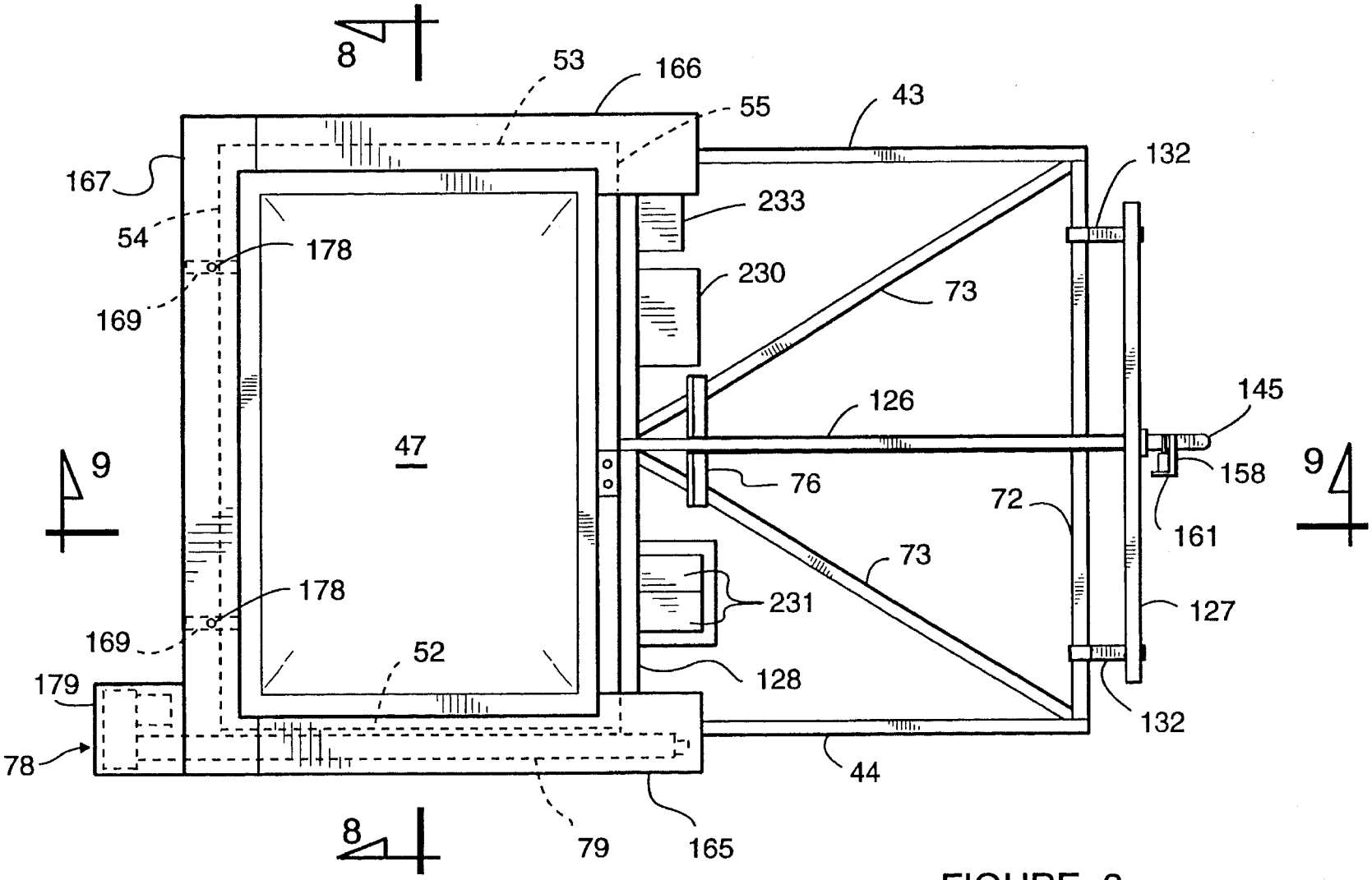
FIG. 3 is a top plan view of FIG. 1.

In this invention, parallel guides or tracks 42 and 43 are secured to the uppermost part of framing 44. In particular a pair of parallel tracks are provided each of which has a left end, a right end and a length. One of the tracks, i.e. The front track 42, is mounted on the outside front surface of side member 52 of the framing and the other track, i.e. the rear track 43, is mounted on the outside rear surface of side member 53 of the framing. The left end 58 of each of the tracks is positioned laterally near the left side member 54 of the framing, and the right end 59 of each of the tracks extends laterally beyond the right side member 55 of the framing a predetermined distance 60. The length of the wracks 42 and 43 is equal to about twice the lateral distance between the outside surfaces of the left and right side members 54 and 55 so that the skylight can be moved completely away from the opening 50 through the framing 44. Thus, the skylight can lie directly over opening 50, or the it can be moved completed away from opening 50 as shown in FIG. 2. The skylight can also be positioned when desired to cover only a part of opening 50 through framing 44.

Figure 4:
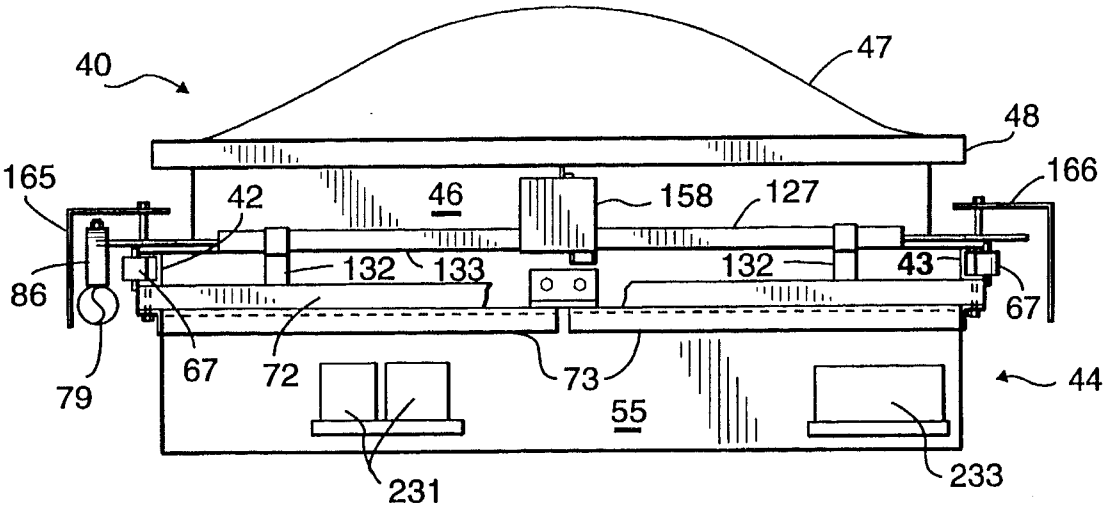
FIG. 4 is a right side elevational view of FIG. 1.
Figure 5:
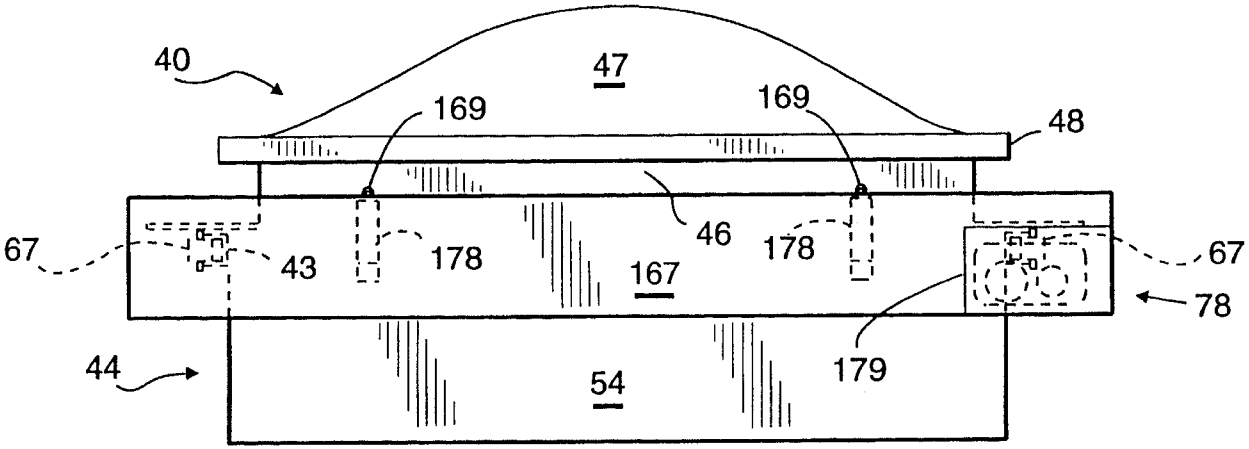
FIG. 5 is a left side elevational view of FIG. 1.
Figure 6:
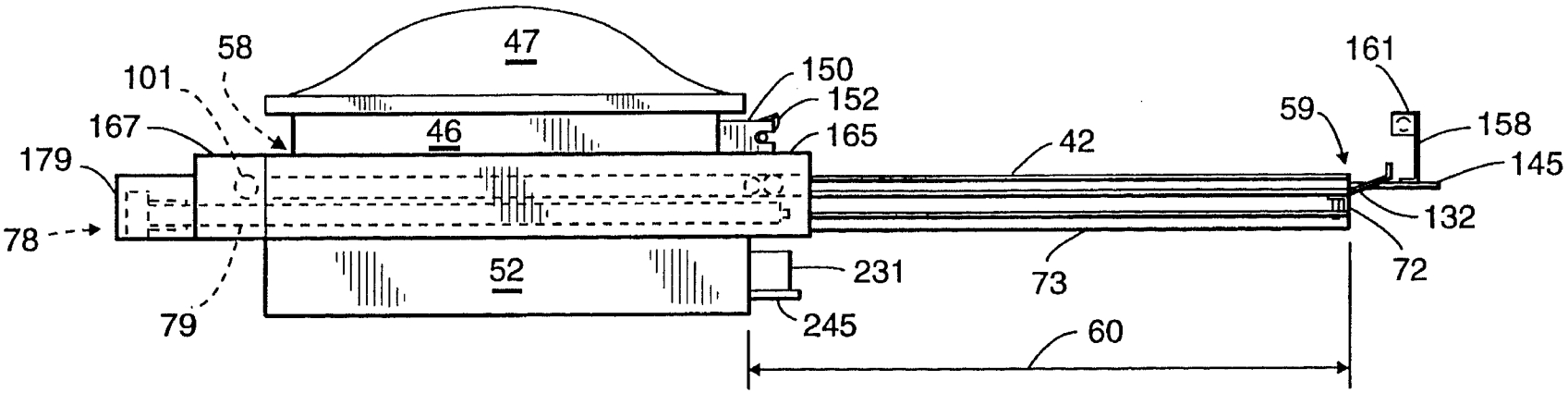
FIG. 6 is a front elevational view of FIG. 1.
Figure 7:
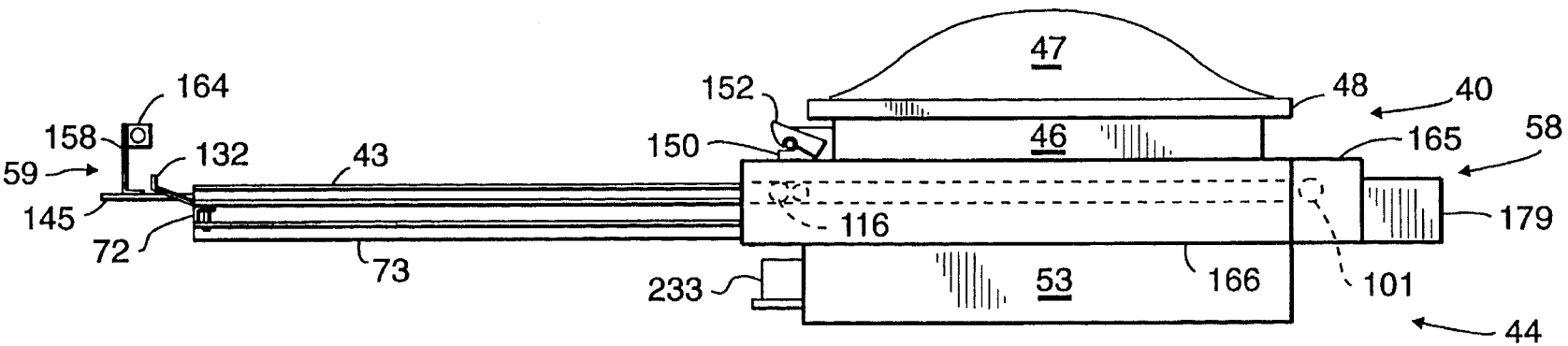
FIG. 7 is a rear elevational view of FIG. 1.

In the embodiment shown in FIG. 1, horizontal flashing 41 also serves as the carriage. However, if an existing skylight does not have a horizontal flashing, or a member which can also serve as a carriage means, then a carriage must also be provided to complete the retrofitting process. In the embodiment of FIG. 1, however, carriage 41 is slideably mounting to the parallel tracks 42 and 43 with rollers. As shown in FIGS. 8, 13, 14 and 16, front and rear parallel track members 42 and 43 are U-shaped with upper and lower flanges 63 and 64, respectively, dependent from base part 65. The parallel tracks are secured to the framing by a plurality of screw fasteners 66 through base part 65. Rotatably mounted on each of the front and rear portion of carriage 41 are three carriage rollers 67 secured by bolts 68. Rollers 67, each having a vertically disposed axis, ride partly within the tracks channels. The distance between the rollers on the front track member 42 and the rollers on the rear track member 43 is adjusted so that the carriage can not become derailed from the channels as the carriage moves from left to right to left along the track, as best illustrated by FIGS. 4 and 8.

Figure 9:
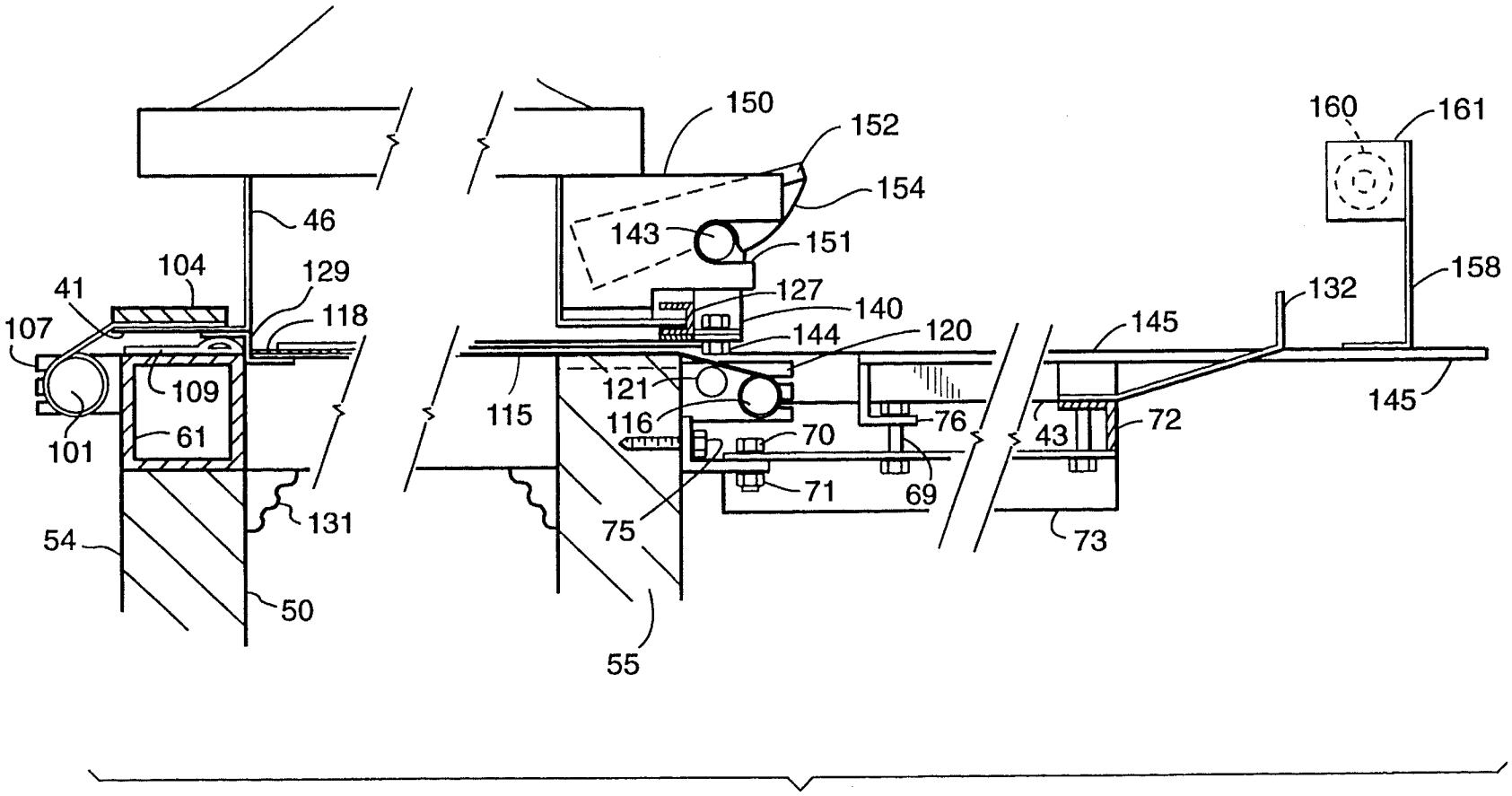
FIG 9 is an enlarged detailed cross-sectional view taken through line line 9—9 of FIG. 3 with the left and rear shields removed to show the flexible screen, screen roller and shade, with the shade pulled over the opening in the framing.
Figure 10:
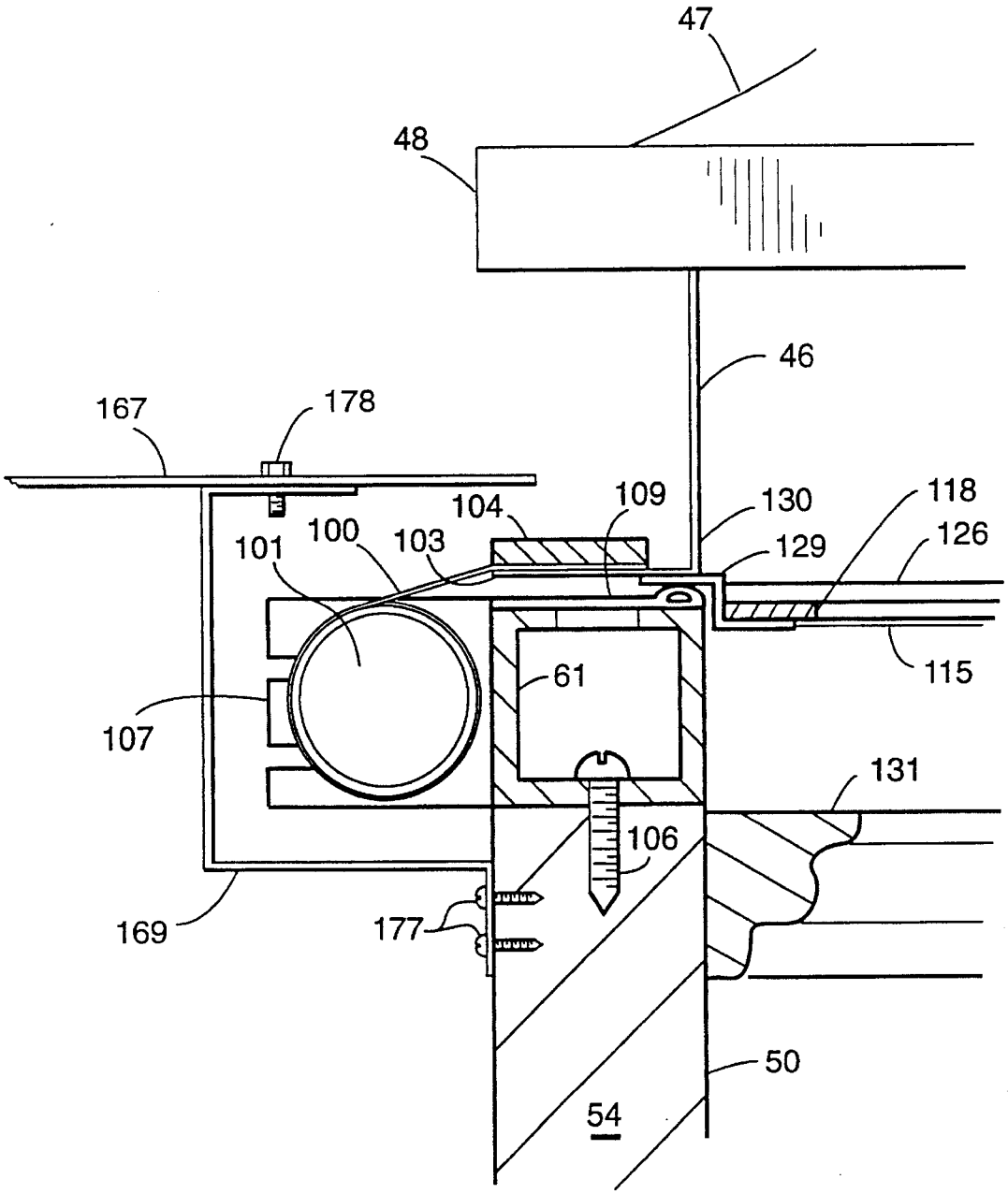
FIG. 10 is a greatly enlarged detailed elevational view of left port on of FIG. 9 to show more details.
Figure 11:
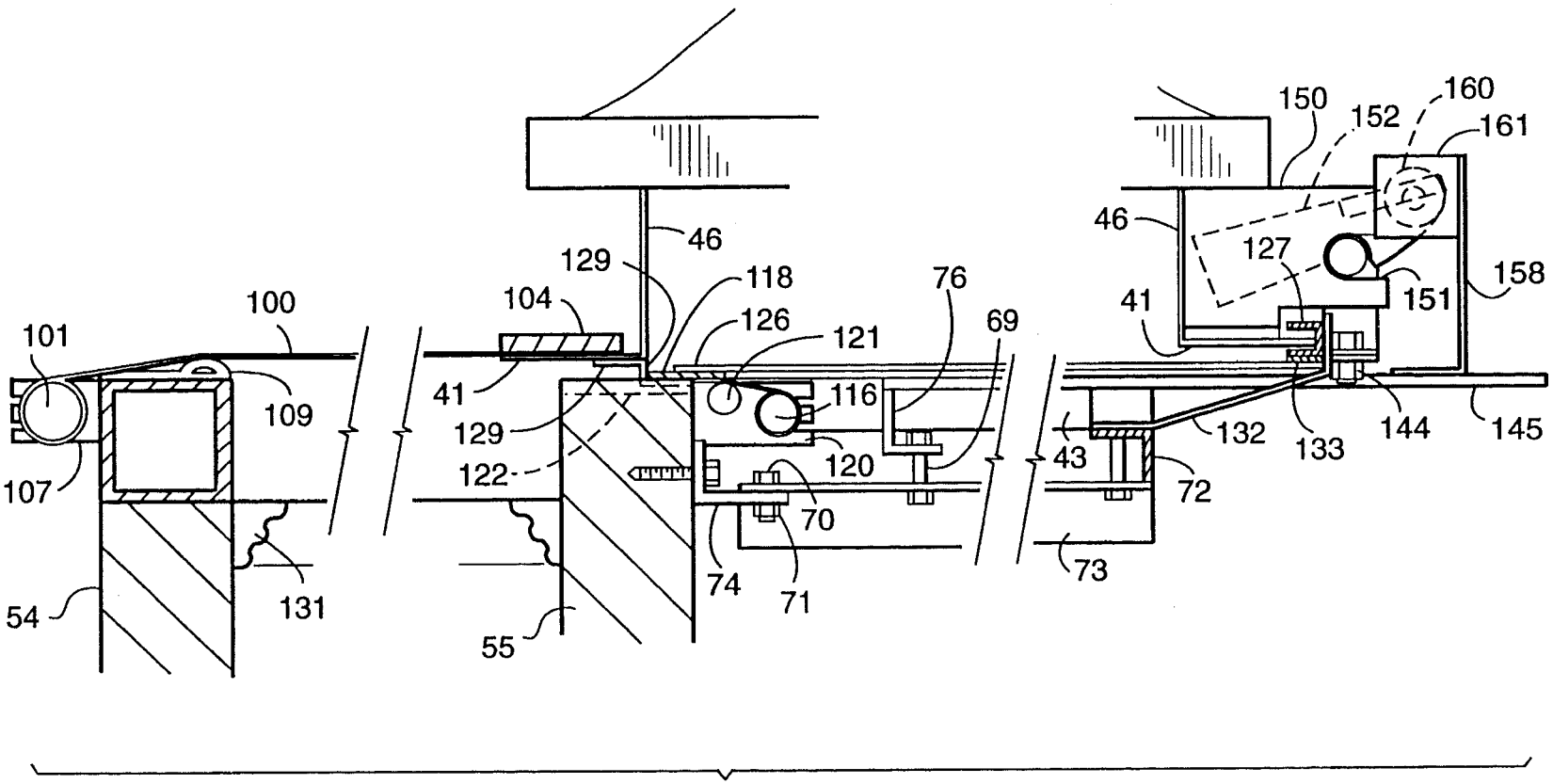
FIG. 11 is an enlarged detailed cross-sectional elevational view similar to FIG. 9 but with the flexible screen pulled completely over the opening in the framing and the skylight completely displaced from the opening.
Figure 12:
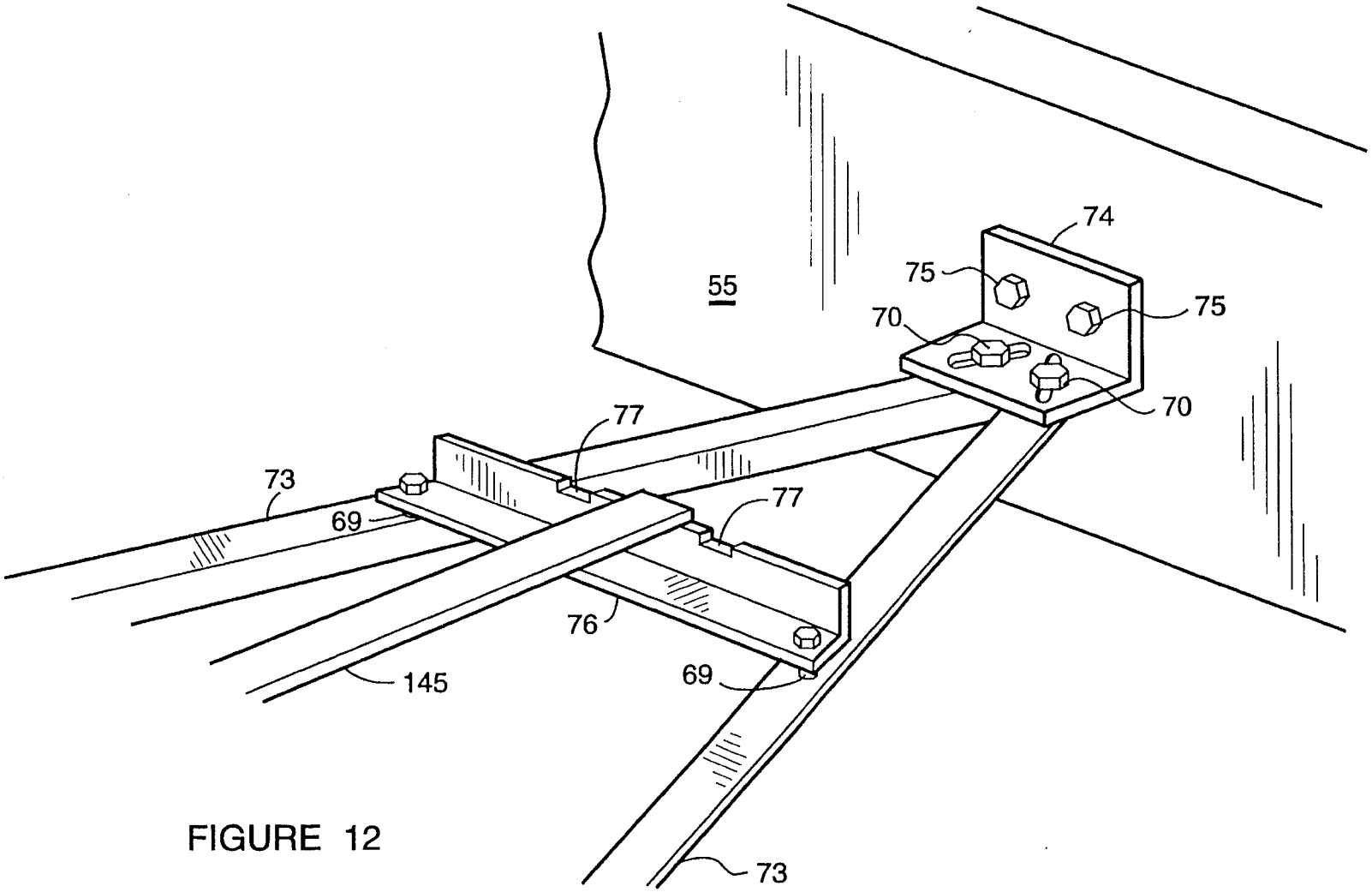
FIG. 12 is a greatly enlarged perspective view of the support structure for the parallel tracks and the mounting of the structure to the framing.

Referring to FIGS. 1, 9, 1.1, 12 and 17, in order to provide for support and rigidity of the extended distal right ends 59 of the parallel tracks, a traversely disposed steel cross member 72 is bolted to right ends 59 of the tracks. The right ends of two diagonally disposed steel angle members 73 are welded to the front and rear ends of member 77. The left ends of angle members 73 are bolted with blots 70 and nuts 71 to a steel angle bracket 74 which is bolted to the center of right side member of framing below shade roller 116 with blots 75. A traversely disposed short angle member 76 is rigidly fixed to the top of angle members 73 with spacers 69 to provide for additional rigidity. It should be noted that FIGS. 9 and 11 are not drawn to scale and that some elements of the apparatus have been made smaller or larger than scale in order to emphasis certain features of the apparatus. For example the vertical face of angle 76 has been lengthen in PIGS 9 and 11.

Figure 13:
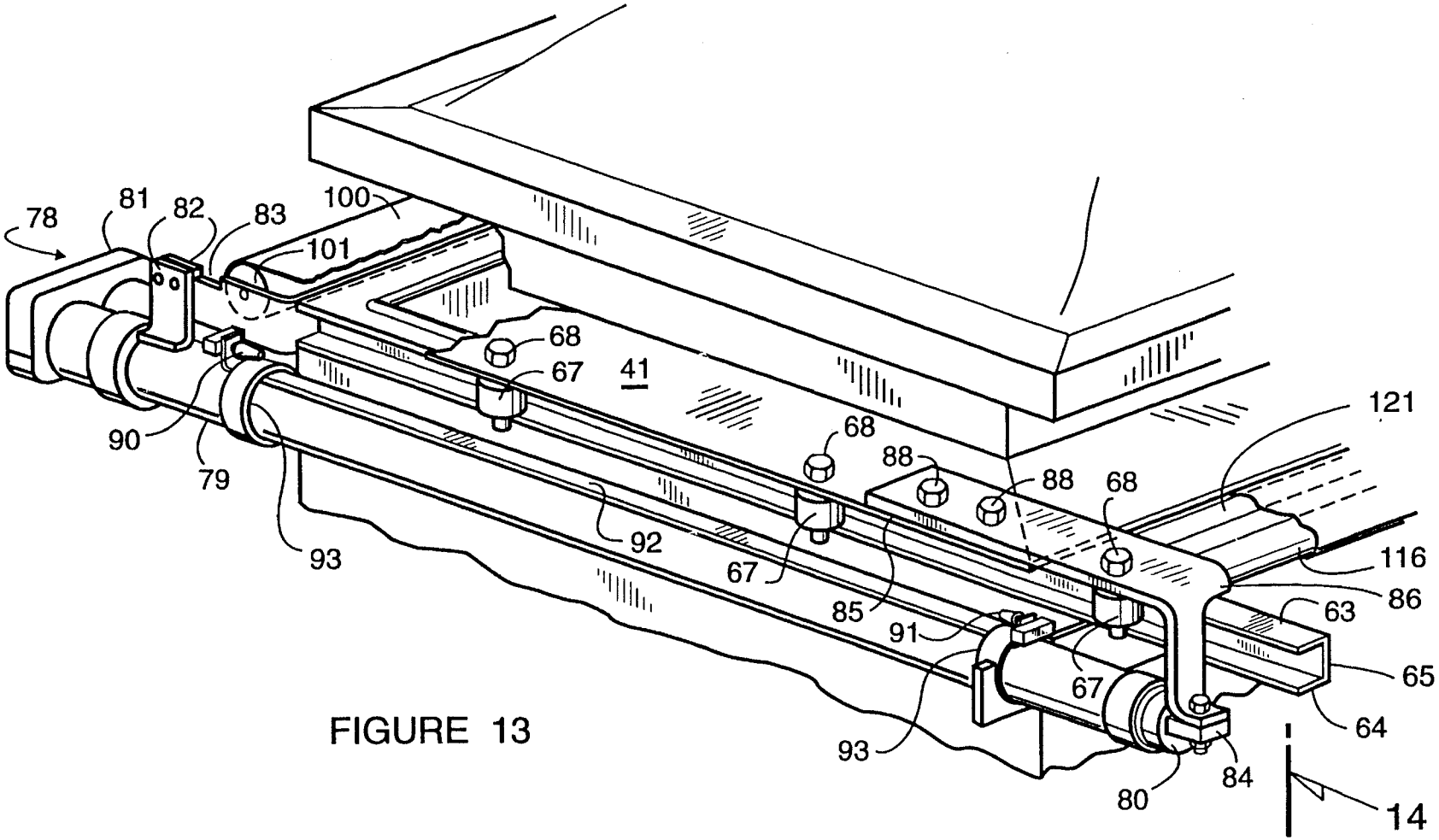
FIG. 13 is an enlarged detailed perspective view of FIG. 1 with the front and left shields removed to show the linear actuator and its connection to the carriage.
Figure 14:
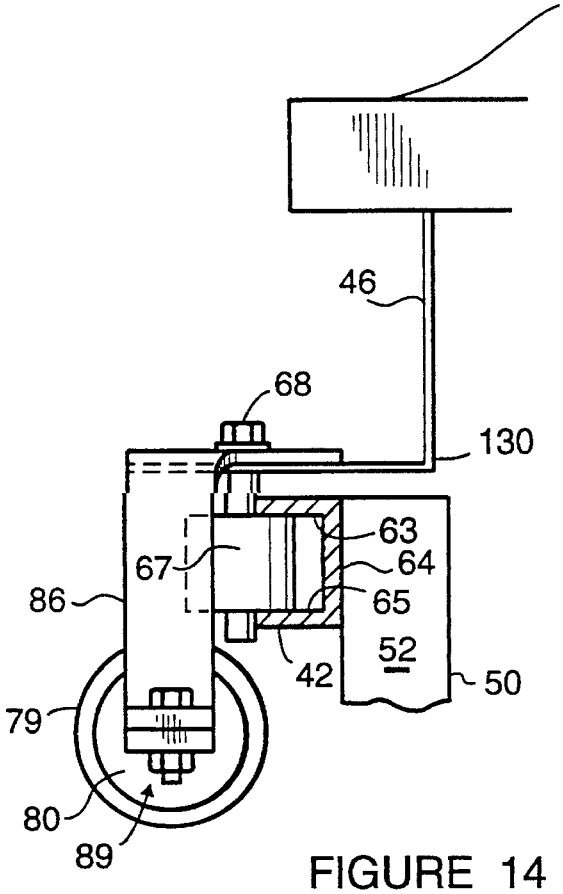
FIG. 14 is a detail view of the connection of the telescoping member to the carriage taken in the direction of line 14 of FIG. 13.
Figure 15:
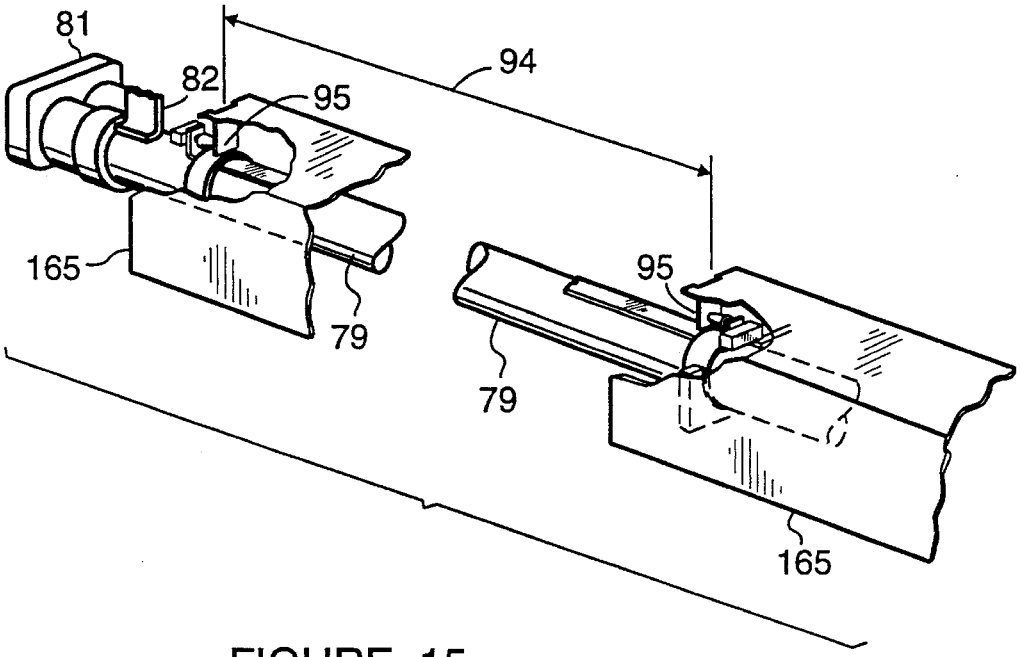
FIG. 15 is a break away detail showing the arm member or bumper flange on the front shield for triggering the limit switches.

Referring to FIGS. 13–15, a conventional linear actuator 78 having a stationary rooter housing 79, a telescoping inner member 80 and a motorized drive unit 81, provides means for moving the carriage 41 along parallel tracks 42 and 43. A right end portion of outer housing 79 is secured to left side member 54 of framing 44 by mounting L-brackets 82 and 83. The distal free end 84 of telescoping member 80 is attached to a left portion 85 of carriage 41 by Z-bracket 86 and fasteners 88 and 89.

When employing an off-the-shelf linear actuator, usually the total linear displacement of the linear actuator will be greater than that required to move the carriage and skylight completely away from opening 50 through framing 44. Therefore, to prevent the left edge 87 of the carriage from moving an unnecessary distance away from the right side member 55 and hence skylight opening 50, a pair of external limit switches 90 and 91 are provided which are mounted on a laterally disposed spacer member 92. Spacer member 92 is secured to the outer housing 79 of linear actuator 78 by circular clamps or straps 93. Spacer member 92 fixes the distance between the limit switches to a predetermined distance 94 which is equal to the designed displacement of the carriage. The limit switches are triggered by an arm member 95 which is dependent from front shield 165 as shown in FIG. 15. The left side of arm member 95 contacts the left limit switch and the right side of arm member 95 contacts the right limit switch.

If the total linear displacement of the liner actuator is custom made to correspond exactly to the designed displacement of the carriage along the parallel tracks, or when installing new skylights, framing and the skylight displacement apparatuses of this invention with skylights and framing dimensions sized to the full stroke of standard liner actuators, then the external limit switches 90 and 91 are not required with liner actuators having an internal stop at each end of its full stroke.

Referring to FIGS. 2, 10, 11 and 16, a flexible screen 100 is shown wound onto a screen roller 101. The free end 102 of the screen 100 from screen roller 101 is connected across a large portion of the width of the left end 103 of the carriage 41 by traversely disposed press bar 104. Screen roller 101 is rotatably mounted between front L-bracket 83 and rear offset bracket 107. L-bracket 83 is welded to square channel 61. Channel 61 is screwed to the top surface of left side member 54 of the framing by screw fasteners 106. Offset bracket 107 is secured to base part 65 of rear track 43 and rear member 53 of framing by screws 110. Screen roller 101 has a conventional internal spring biased for winding the screen onto the roller which provides means for maintaining the screen in tension. Brackets 83 and 107 are positioned in elevation so that the screen pulls roller 101 at an elevation even with the bead of traversely disposed weather stripping 109 affixed to the top of left side member 54 of framing with fasteners 110. Thus, brackets 83 and 107 provide means for aligning the screen to the framing as the screen is tautly pulled over the bead of weather stripping 109. The Lop surfaces of front and rear side members 52 and 53 are also fitted with weather stripping 111. Screen is large enough to span opening 50 through framing 44.

Since free end 102 of the screen 100 is always attached to the left side 103 of carriage 41, it will be understood that when the carriage is displaced away from left side member 54 of framing 44 that the space between left side member 54 and left end 103 of the carriage will be covered by the screen. Furthermore, the screen will be pulled taut and abut weather stripping 109 and 111 thereby preventing insects from entering through opening 50 through the framing into the interior of the building.

Referring to FIGS. 1, 9–11, 17, 18 and 21, a flexible shade 115 is shown wound onto a shade roller 116. The free end 117 of the shade 115 from shade roller 116 is attached by crimping to a traversely disposed stretch bar 118. Shade roller 116 is rotatably mounted between front and rear L-brackets 120. Brackets 120 are secured to right side member 55 of the framing with screws 123. Roller 116 has a conventional internal spring biased for winding shade 115 onto roller 116 which provides means for maintaining the shade in tension. Located between shade roller 116 and right side member 55 of the framing is an alignment roller 121 which is also rotatably mounted between L-brackets 120. Brackets 120 and alignment roller 121 are positioned in elevation so that shade 115 will be pulled from roller 116 at an elevation very slightly above the top surface of right side member 55 of the framing. Thus brackets 120 and roller 121 provide mean for aligning the shade to top surface of right side member 55 of framing as the shade is tautly pulled thereover. Shade 115 is large enough to cover opening 130 of carriage 41. The height of top surface of right side member 55 is the same as the height of the top surface of channel 61 mounted on left side member 54 of framing except for laterally disposed notch 122 which is lower to provide room for Z-brace 129. Referring to FIGS. 9–11, 17, 18, and 21 the mid-point 125 of shade stretch bar 118 is fixed to the left end of the laterally disposed part of spanner member 126. The right end of spanner member 126 has a traversely disposed part 133 welded thereto which supports traversely disposed U-bar 127. Spanner member 126 is therefore T-shaped. Referring to FIG. 9, when U-bar 127 is displaced to the left as far as it can go, it will abut and cup the right edge 128 of carriage 41 thereby at least partially covering the gap between the right edge 128 of the carriage and the top of shade 115. With the shade in this position, stretch bar 118 rests on and abuts against Z-brace 129 which provides support ton the weights of shade 115, stretch bar 118 its and spanner member 126.

With shade 115 fully extended across most of opening 130 through carriage 41, sunlight entering through transparent member 47 of the skylight is blocked by the shade regardless of where the carriage is positioned along parallel tracks 42 and 43, as can be seen from FIG. 9. A decor molding 131 is frequently used on the inside of the framing to hide the top inside edges of the framing from sight from below.

When U-bar 127 is displaced to the right as far as it will go, as shown in FIG. 11, stretch bar 118 will reduce the gap between the right edge 128 of the carriage and the top surface of right side member 55 of the framing thereby partially blocking insects from entering the interior of the structure over the top of the shade. To support U-bar 127 when the carriage is positioned to the extreme right end of its travel, support brackets 132 mounted on cross member 72 are provided.

Referring to FIGS. 17–20, to cause lateral spanner member 126 to pull shade 115 over that portion of opening 130 through carriage 41 which is over opening 50 through the framing 44, a shade engaging mechanism, generally designated by 135, is provided. Shade engaging mechanism 135 comprises a solenoid mechanism 136 and a connector mechanism 137. Connector mechanism 137 has a first part 138 and a second part 139.

First part 138 of the connector mechanism has two traversely disposed steel L-brackets 140 which are welded to the right distal end 141 of the spanner member 126. A traversely disposed steel dowel 143 is secured to the top of the vertical parts of L-brackets 140 and functions as a first-half connector link. Two bolts 144 are placed in holes drilled through the horizontal parts of L-brackets 140. The bottom portion of the bolts 144 serve as a follower for riding on laterally disposed center guide bar 145. The left end 146 of center guide bar 145 is secured to the top, center of short angle member 76. A section 147 of center guide bar 145 near the ring end thereof is welded to the top, center of cross member 72. The bottom part of bolts 144 straddle center guide bar 145. When the spanner member 126 is coupled to carriage 41, and as carriage 41 travels to the left end of the parallel tracks, the bottom of bolts 144 pass through notches 77 in member 76. The traversely disposed part 133 of spanner member 126 rides up on shade roller 116 and roller 121 thereby allowing U-bar 127 to cup over left edge 128 of carriage 41. Therefore bolts 144 and center guide bar 145 provide means for preventing the shade from rewinding on to roller 116 at an angle which could cause damage to the shade.

The second part 139 of connector mechanism 137 has a metal angle member 150 which is mounted on the center portion of the right vertical member 46 of carriage 41. Angle member 150 has a horizontal recess 151 for receiving dowel 143. A traversely disposed lever 152 is pivotally mounted to member 150 with bolt 153. Lever 152 has a cam surface 154 and a vertical recess 155. When lever 152 drops down, recess 155 is aligned with a part of recess 151. Therefore, recess 155 provides, in part, means for receiving and locking carriage 41 onto dowel 143. Stop pin 156 prevents lever 152 from rotating too far in either direction.

The solenoid mechanism 136 has four-flange bracket 158, the lower horizontal flange 159 of which is mounted on, and secured to, a section of center guide bar 145 near the distal end thereof. A solenoid 160 is mounted on the laterally disposed front vertical flange 161 of bracket 158. When plunger 162 of solenoid 160 is retracted, cam surface 154 and dowel 143, in combination, cause lever 152 to pivot up as carriage 41 is displaced to its extreme right position away from opening 50 through framing 44. When recess 155 reaches dowel 143 lever 152 drops over dowel 143 thereby connecting the first and second parts 138 and 139 of connector mechanism 137 together However, when plunger 162 of solenoid 160 is extended, cam surface 154 of lever 154 engages root only dowel 143 but also plunger 162 as carriage 41 displace to its extreme right position away from opening 50 through framing 44. Extended plunger 162 prevents lever 152 from dropping over dowel 143, thereby preventing the first and second parts 138 and 139 of the connector mechanism 137 from connecting together. To prevent plunger 162 from falling out its of solenoid, a rear vertical flange 164 is provided which abuts distal end 163 of plunger 162.

If, however, the first and second parts of connector mechanism are already connected together, and if plunger 162 of solenoid 160 is extended, cam surface 154 of lever 152 will engage plunger 162 as carriage 41 travels to the right and is located at its extreme right position away from opening 50 through framing 44. Cam surface 154 and extended plunger 162 cause lever 152 to pivot up thereby freeing dowel 143 from recess 155 which causes the first and second parts of connector mechanism to uncouple or disconnected.

Thus connecting and disconnecting of the connector mechanism occurs when the carriage 41 reaches its extreme right position away from opening 50 through framing 44, and will depend on whether or not the plunger 162 of solenoid 160 is extended or retracted.

When spanner member 126 is unconnected from carriage 41, spanner member 126 remains in its extreme right position away from opening 50 through framing 44, and shade 115 will be stored almost completely on shade roller 116.

When spa floe r member 126 is connected to the carriage, shade 115 will pulled from shade roller 116 and to be deployed across the space between the right side member 55 of framing 44 and the left end of opening 130 through the carriage 41. Thus, if the carriage 41 is completely over opening 50 through the framing, shade 115 will be completely over opening 130 through the carriage and hence also completely over the opening 50 through the framing.

To protect the telescoping member 80 of linear actuator 78, and the carriage rollers 67, from rain and snow, front and rear shields 165 and 166 are provided. Shields 165 and 166 are attached to carriage 41 by spacer-bolts 168. Shields 165 and 166 travel with carriage 41. To protect the flexible screen 100, and the seam between carriage 41 and the left side member 54 of the framing, from rain and snow, a left shield 167 is provided which is attached to the left side member 54 of the framing by brackets 169 and screws 177 and 178. An additional small shield 179 is attached to shield 167 to protect the drive unit of linear actuator 78. The flexible shade, and the space between the carriage and the right side member 55 of the framing, are protected from rain and snow, by the right end 128 of carriage 41 which overhangs the space and roller 121, and by U-bar 127 which cups over right end 128.

Figure 22:
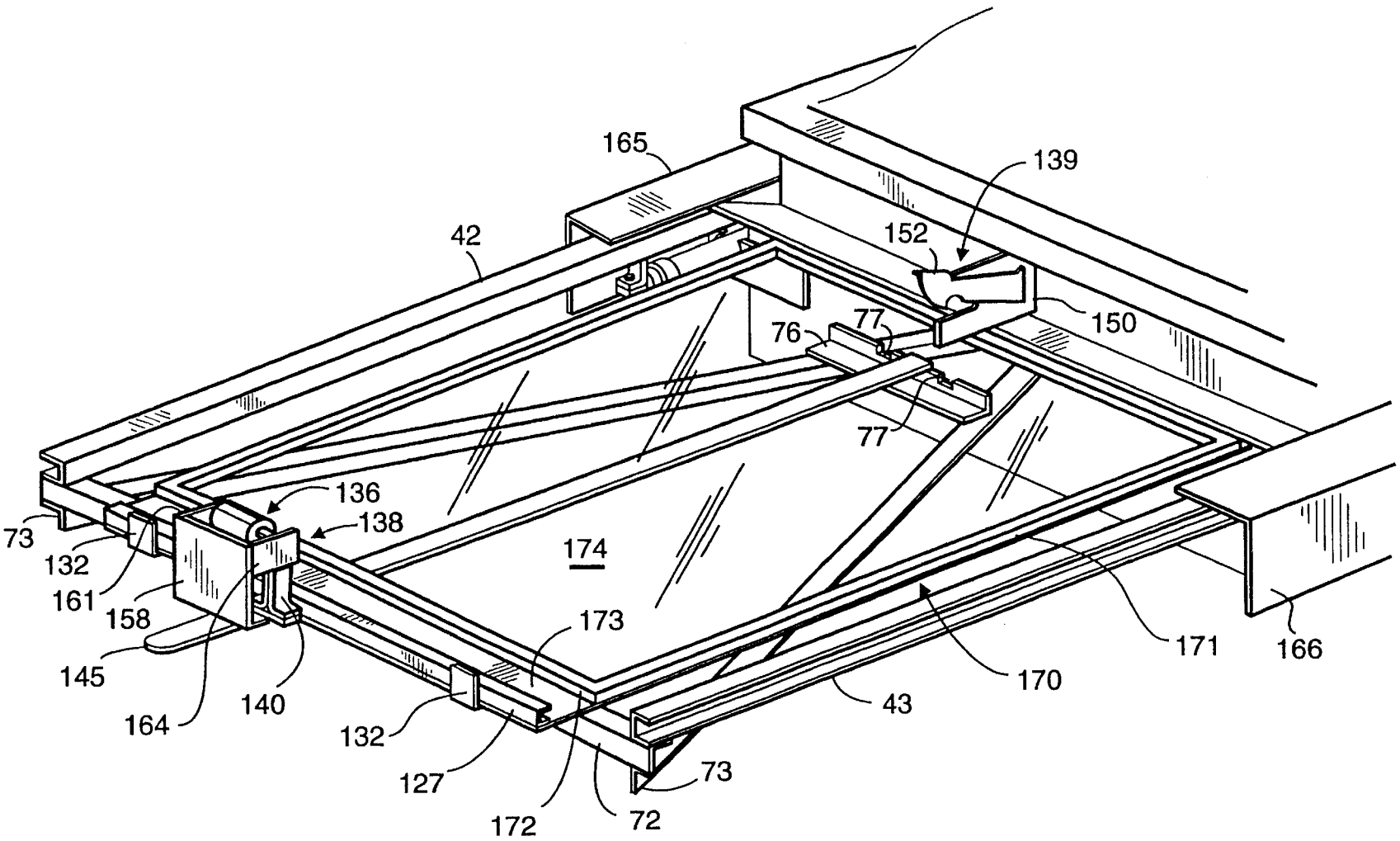
FIG. 22 is another embodiment of this invention with a tray member with a tinted transparent panel, instead of the flexible shade of FIG. 18.

In another embodiment of this invention, the flexible shade is replaced with panel type shade. Instead of roll-up shade 115 and spanner member 126, a rigid tray member 170 is employed. In particular, and as illustrated in FIG. 22, tray member 170 has a metal encasement frame 171, the right end 172 of which is attached to left end of an apron 173. On the right end of apron 173 is mounted traversely disposed U-bar 127 and first part 138 of connector mechanism 137.

Encased within metal encasement frame 171 is a panel 174. Panel 174 can be fully or partly opaque to sunlight, or have a mirror surface to reflect sunlight, or have a decorative panel such as stained glass, or any other type of panel desired, or any combination of the foregoing. In another embodiment, not shown in the drawings, the metal encasement frame 171 has a plurality of openings formed by a lattice frame work, and the panel member is a plurality of panels fitted into the lattice frame work.

Mounted by rivets on, and supported by, the right flange of carriage 41 is the second part 139 of connector mechanism 137. Mounted on and supported by the center guide bar 145 is the solenoid mechanism 136. Solenoid mechanism 136, first and seconds parts 138 and 139 of connector mechanism 137, and U-bar 127 performs the same functions as the corresponding components of the previously described embodiment of this invention.

Thus, the shade engaging mechanism 135 used for the embodiment shown in FIG. 22 can be, and preferably is, the same as that described for flexible roll-up shade 115. Accordingly, the shade engaging mechanism shown in FIG. 22 comprises a solenoid mechanism 136 and a connector mechanism 137. The connector mechanism has a first part 138 and a second part 139, as described with regard to the mechanism described for FIGS. 17–20 for flexible shade. In one embodiment, the apparatus is designed so that the spanner member, flexible shade and U-bar of the first embodiment can be removed and easily replaced with the tray member 170 of the embodiment shown in FIG. 22.

Figure 23:
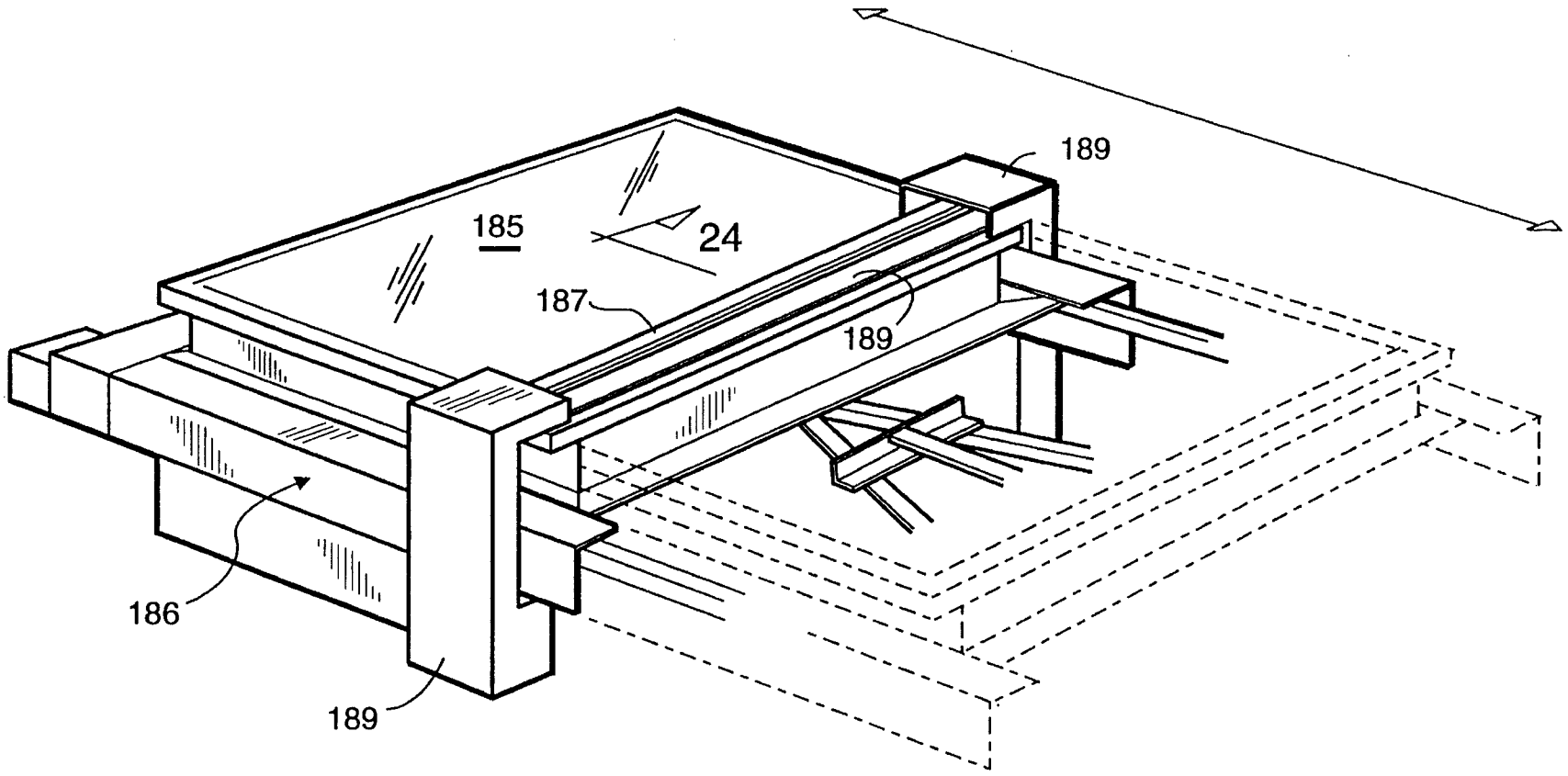
FIG. 23 is another embodiment with a flat glass skylight equipped with a squeegee and brush for remotely cleaning the skylight glass.
Figure 24:
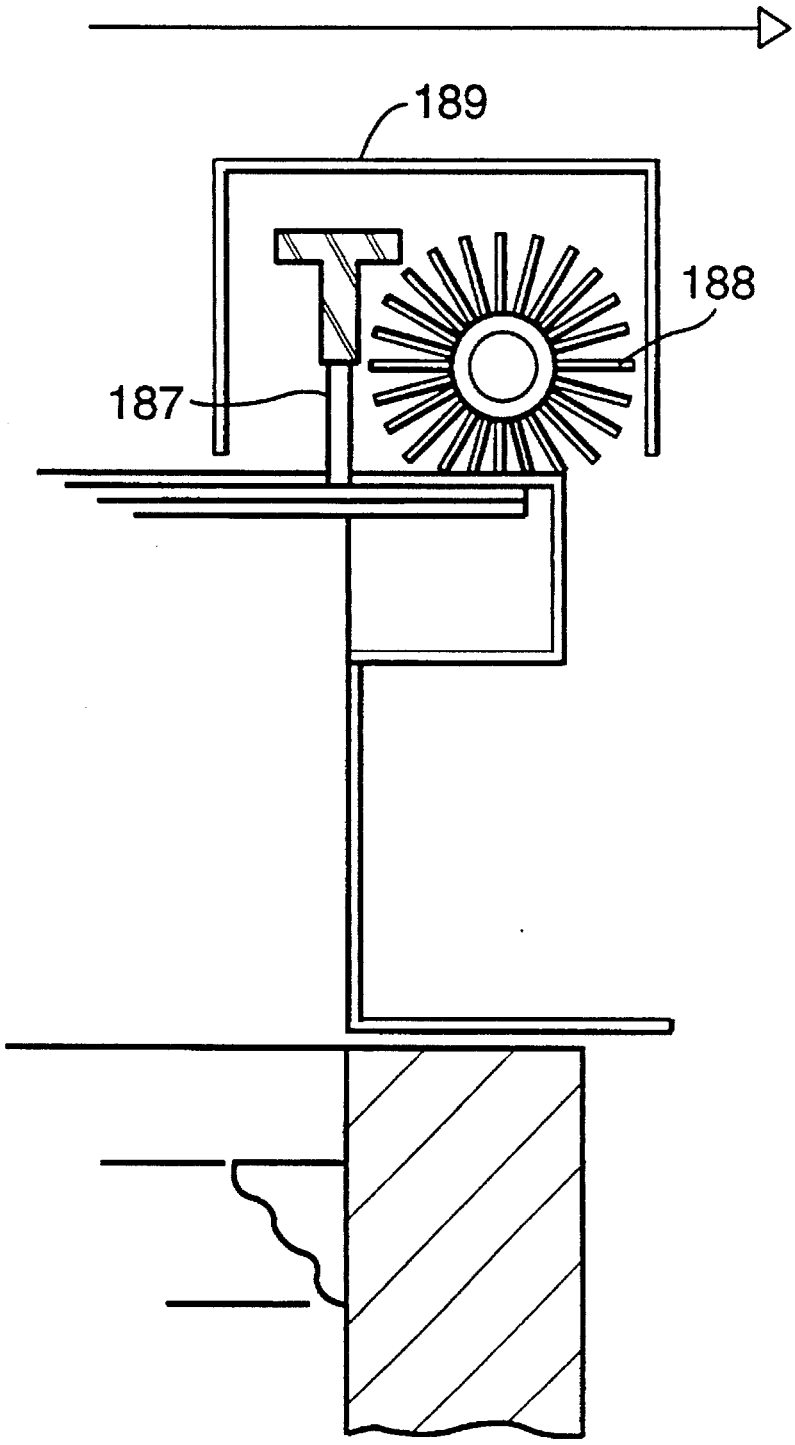
FIG. 24 is cross-sectional view taken in the direct 15 line 24 of FIG. 23.

FIGS. 23 and 24 represent another embodiment in which the dome shape glass 47 has been replaced with a flat glass 185 and a glass cleaning mechanism 186 which contains squeegee 187 and brush 188 mounted in housing 189 for remotely cleaning the skylight glass.

Figure 25:
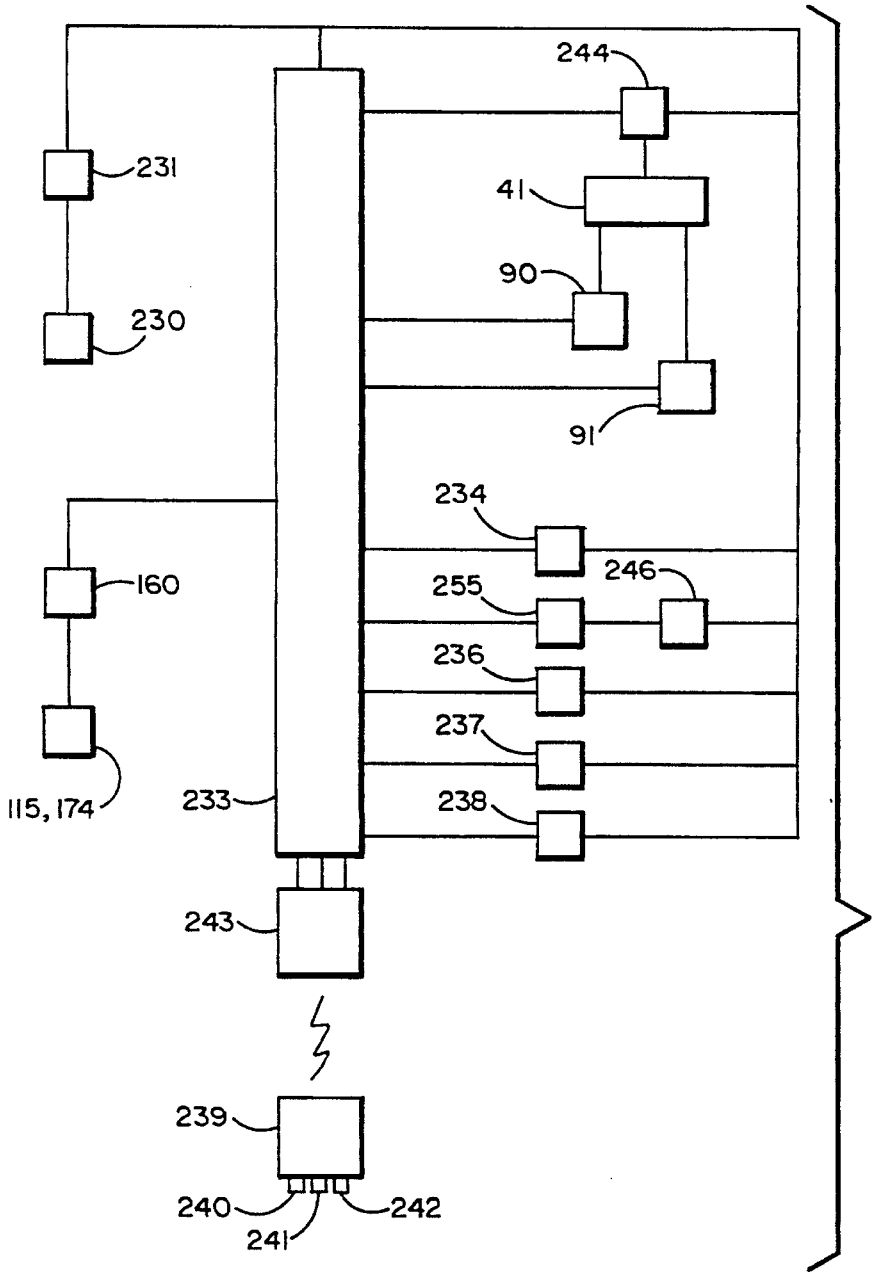
FIG. 25 is a general schematic block diagram of a remote control system of this invention.

FIG. 25 is a schematic block diagram of the electrical circuit for these embodiments. Solar panel 230 maintains battery 231 in full charge state. Battery 231 powers controller or control board 237, smoke detector 234, smoke alarm 235, moisture detector 236, motion detector 237 and motion alarm 238. Transmitter 239 having button 240 for opening carriage 41, button 241 for closing carriage 41, and button 242 for energizing solenoid 160, is used for transmitting coded signals to receiver 243. Receiver 243 decodes the signals received from transmitter and sends the corresponding decode signal to controller 233. Controller 233 signals motor 244 to drive linear actuator 78 thereby opening or closing carriage 41 depending upon which of buttons 240 or 241 is pressed. Limit switches 90 and 91 signal controller 233 when the telescoping member 80 of linear actuator 78 reaches the ends of its stroke and controller 733 stops motor 244.

Controller 233 also energizes solenoid 160 when button 242 is pressed to retract plunger 163, thereby permitting spanner member 126 and shade 115, or tray member 170, to connect to carriage 41. This enables shade 115 or panel 174 to cover, fully or partly depending on position of carriage 41 on the parallel tracks, opening 130 through the carriage. Controller 233 also sets the priorities of the automatic and transmitted functions.

Figure 16:
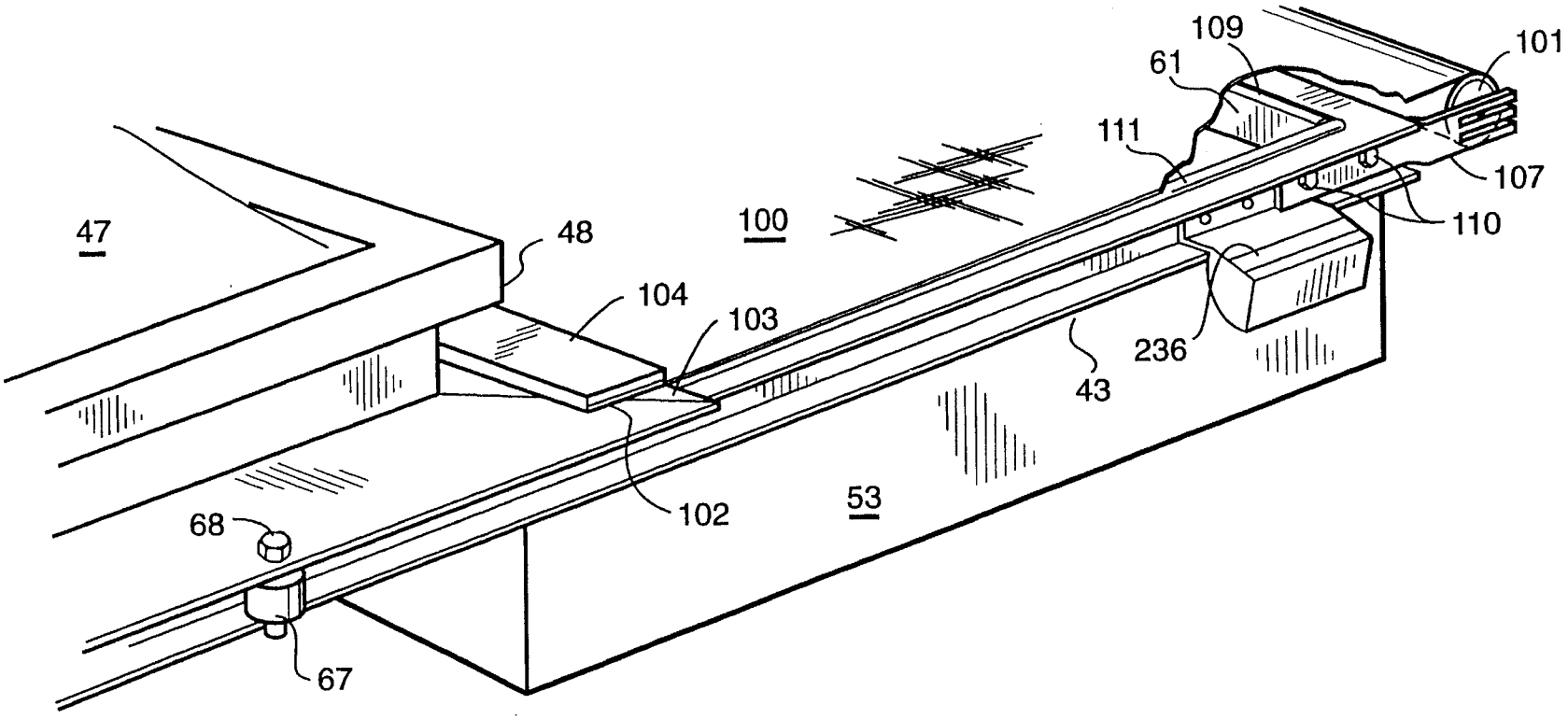
FIG. 16 is an enlarged detailed perspective view of FIG. 2 with the rear and left shields removed to show the flexible screen deployed over the opening in the framing, and moisture detector.
Figure 17:
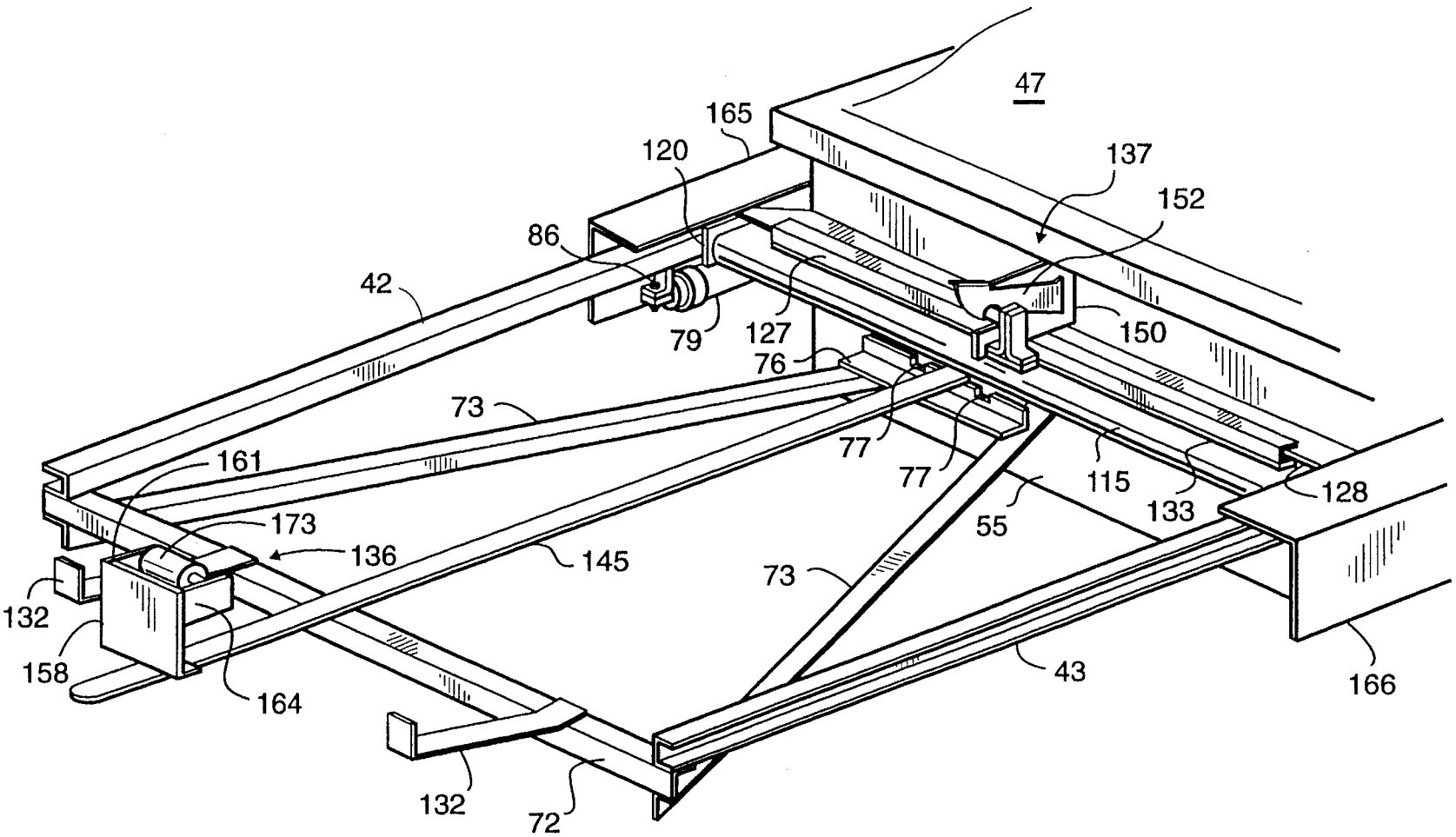
FIG. 17 is an enlarged detailed top, right and rear perspective view of FIG. 1 showing the flexible shade and shade roller with the shade connected to the carriage and the U-bar covering the small gap between the top of the right edge of the framing and the shade.
Figure 18:
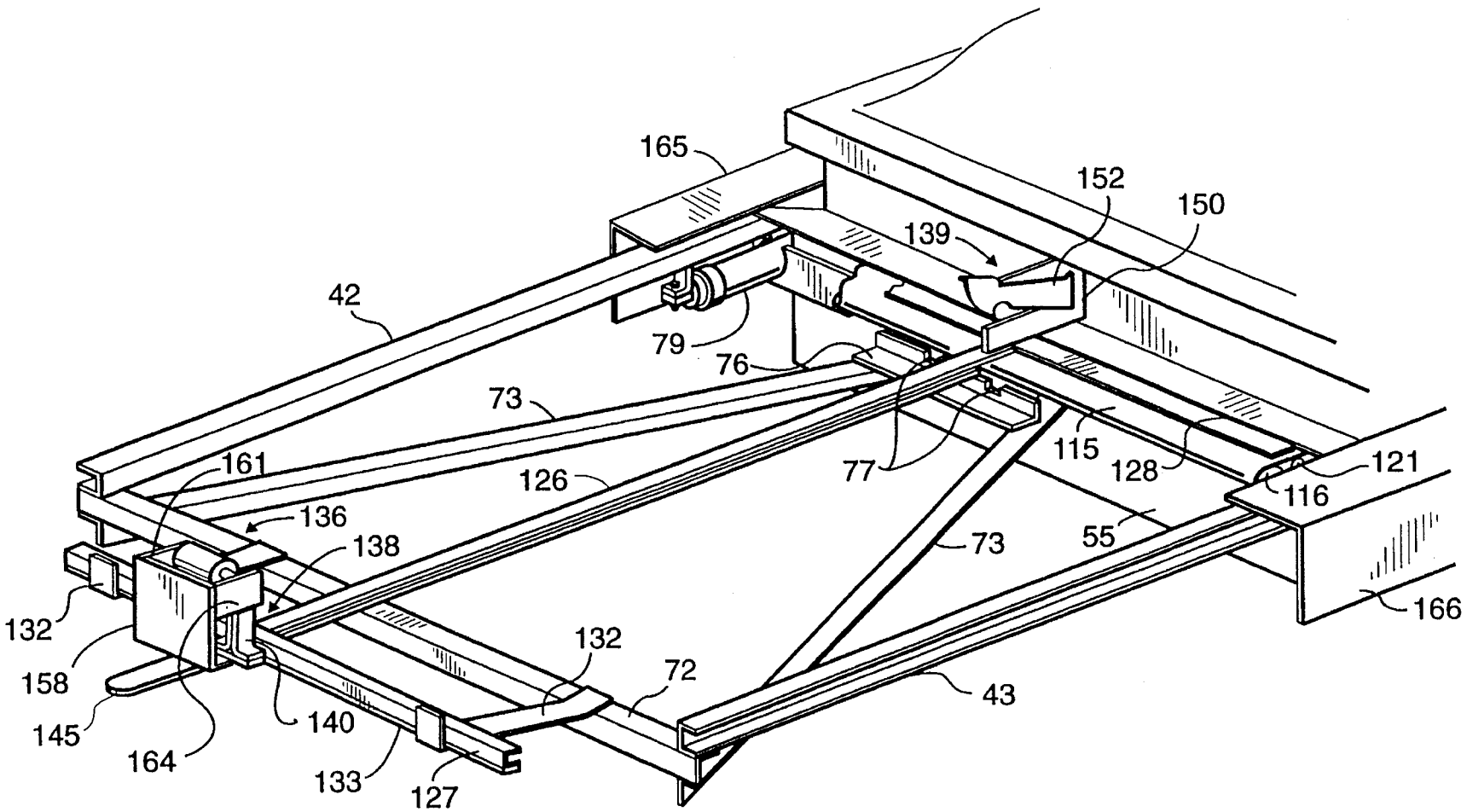
FIG. 18 is another detailed view, similar to FIG. 17, but with the flexible shade wound on the shade roller and with the shade disconnected from the carriage, and with the spanner member parked in it extreme right position.
Figure 19:
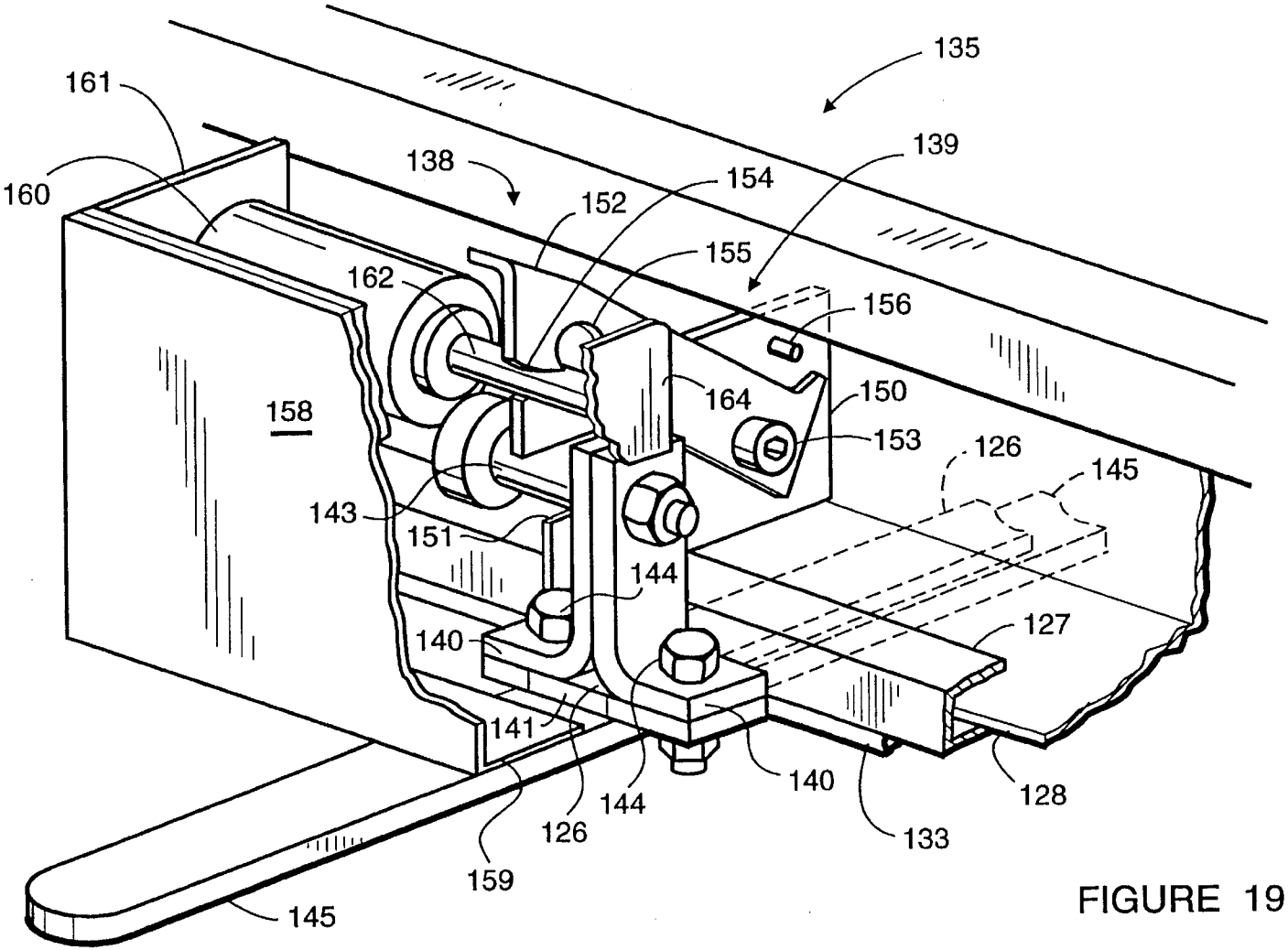
FIG. 19 is a greatly enlarged detail of the solenoid mechanism and the shade engaging mechanism with both parts of the shade engaging mechanism disconnected.
Figure 20:
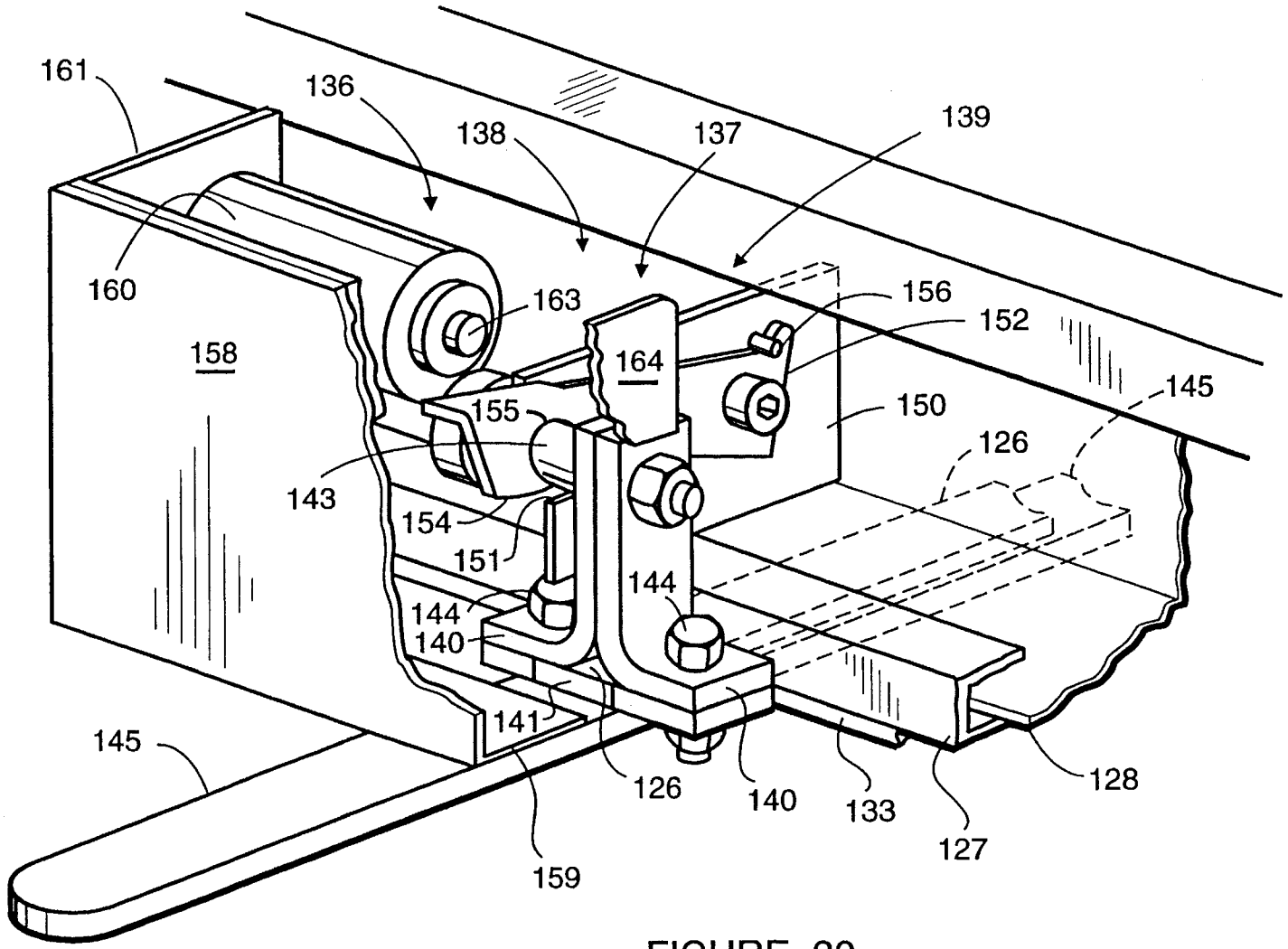
FIG. 20 is another greatly enlarged detail of the solenoid mechanism and the shade engaging mechanism, similar to FIG. 19, but with both parts of the shade engaging mechanism connected
Figure 21:
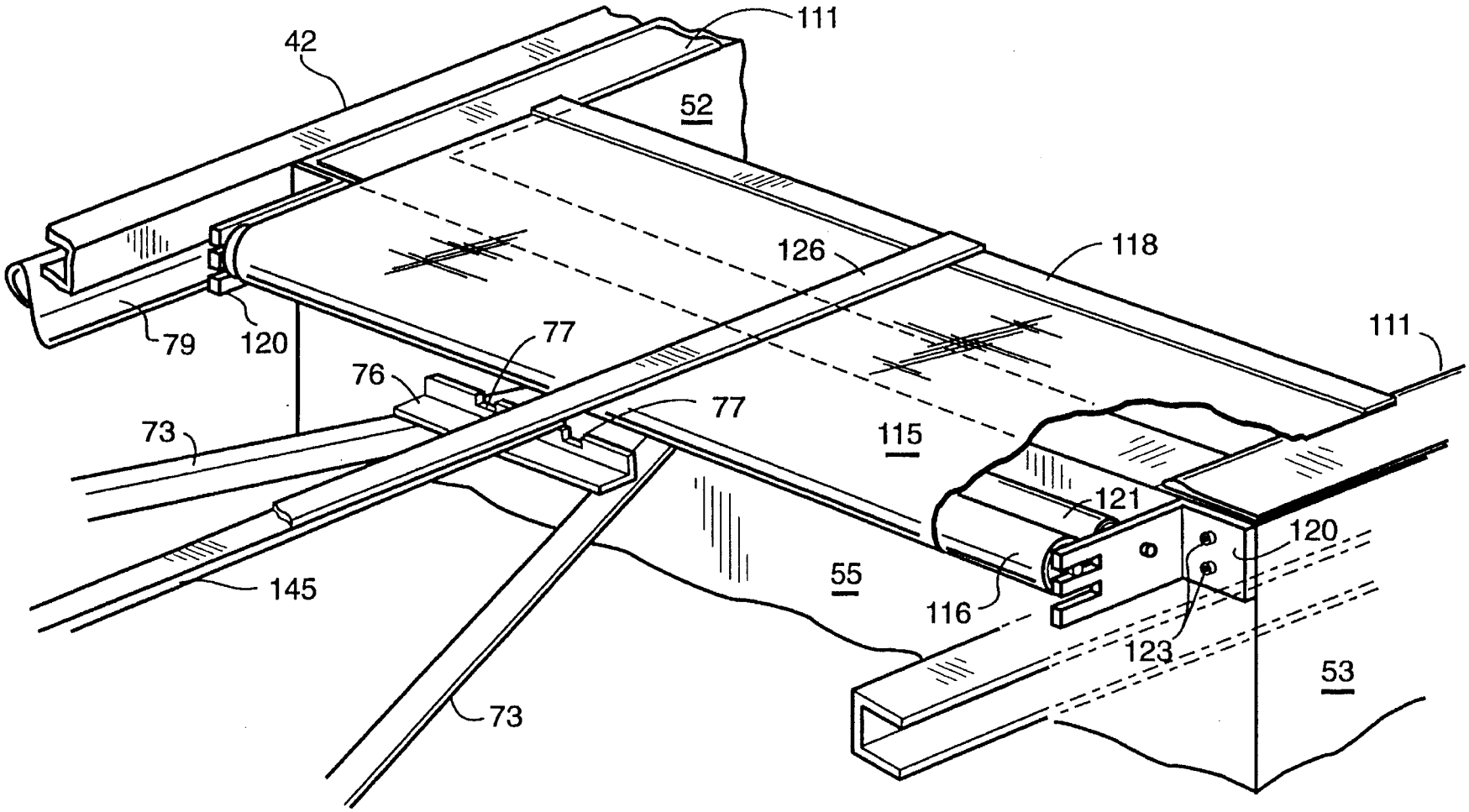
FIG. 21 is an enlarged top, right and rear detailed perspective view of the apparatus of FIG. 1 with the front and rear shields and skylight removed to show the flexible screen partly deployed over the opening through the framing.

Moisture detector 236 can be mounted on at a convenient location such as on the rear side member 53 as shown in FIG. 16. In this location the moisture detector will be under the rear shield 166 the skylight is closed, which will occur when it is raining or snowing. Battery 231 can be mounted on bracket 245 on the right side member 55 of framing 44. Solar panel 230 can be mounted on the framing at a location where the solar panel will receive on an average day the greatest exposure to sunlight. Motion detector 236 can be mounted on the roof or other structure near the location of the framing at a point where an intruder intent on entering through the opened skylight, would be. Smoke detector 234 and alarms 235 and 238 would be usually be placed inside the building structure. When smoke or motion is detected alarms 235 or 238 ring. Once activated alarm 235 will continue to ring until it is turned off by manual switch 246.

The controller 233 works as follows. Maintaining button 240 in a depress condition, causes motor 244 to move carriage 41 to the right thereby opening the skylights. When button 240 is released, or when limit switch 91 is activated, motor 244 stops. Maintaining button 241 to a depress condition, causes motor 244 to move carriage 41 to the left thereby closing the skylights. When button 241 is released, or when limit switch 90 is activated, motor 244 stops. Plunger 162 of de-energized solenoid 160 is normally extended. Maintaining button 242 in a depress condition, activates solenoid 160 and causes plunger 162 to retract thereby allowing lever 152 to couple to dowel 143.

Figure 26:
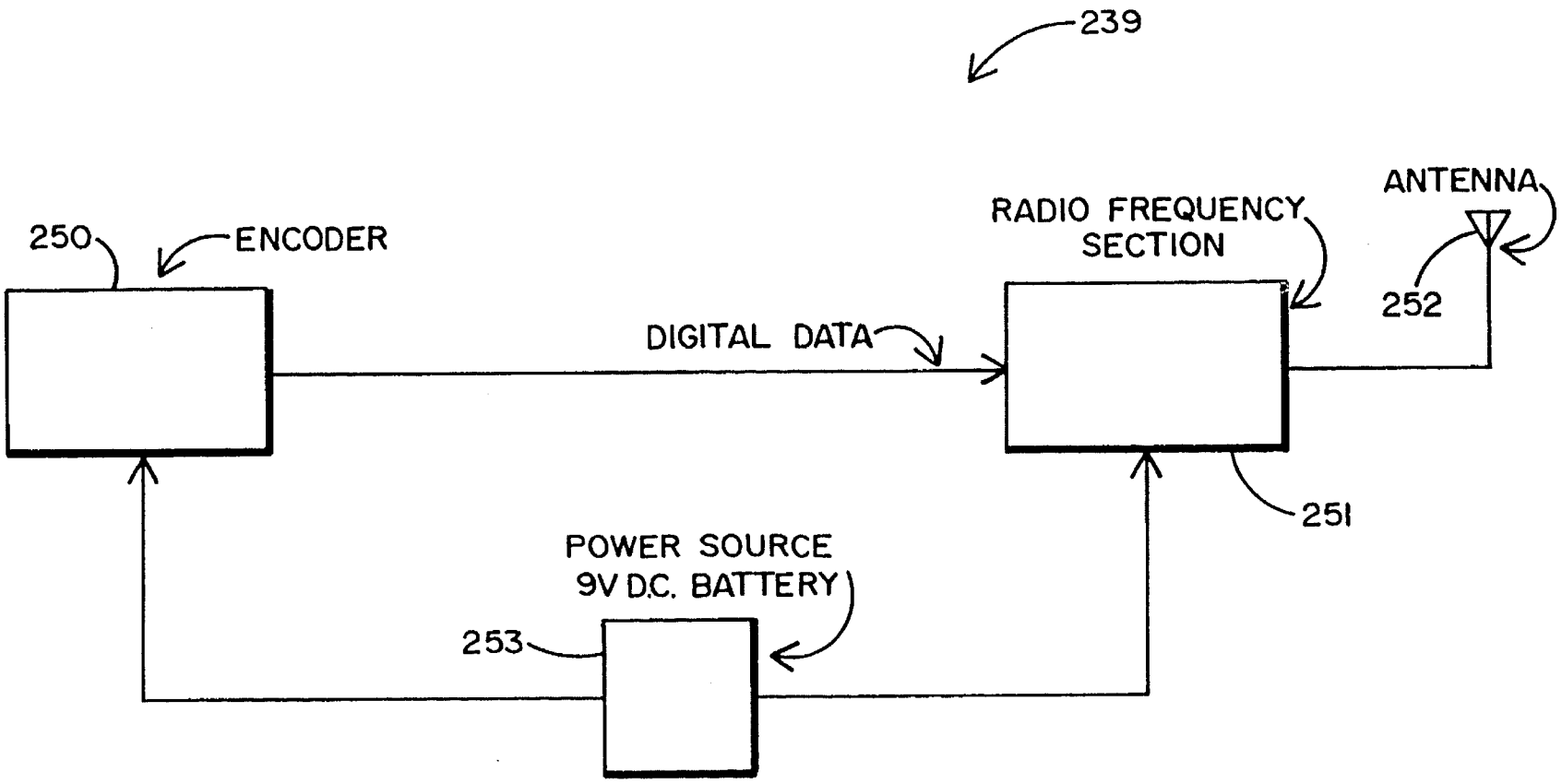
FIG. 26 is a schematic block diagram of a remote transmitter circuit of this invention.
Figure 27:
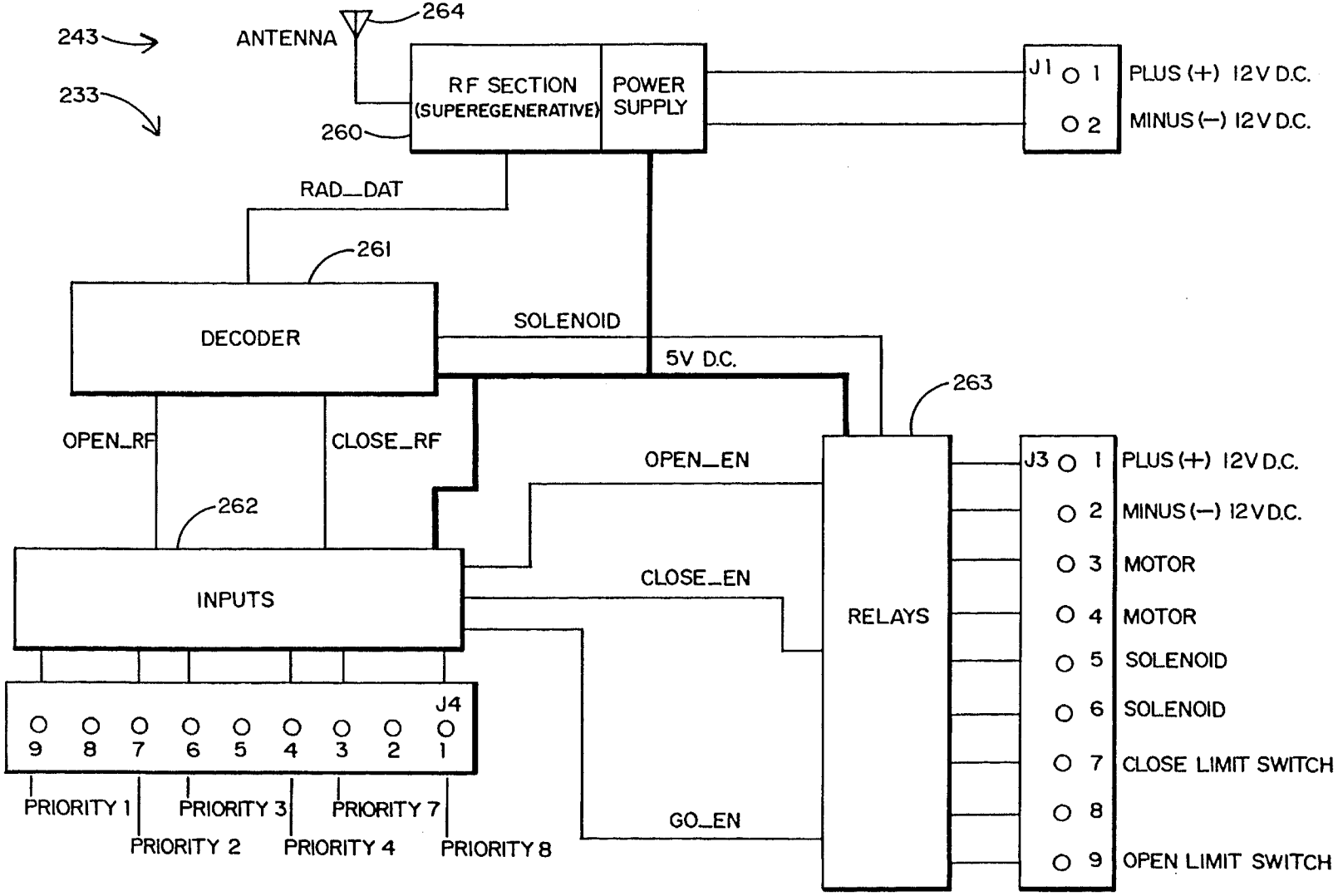
FIG. 27 is a schematic block diagram of a control board for receiving coded signals from the transmitter of FIG. 26.
Figure 28A:
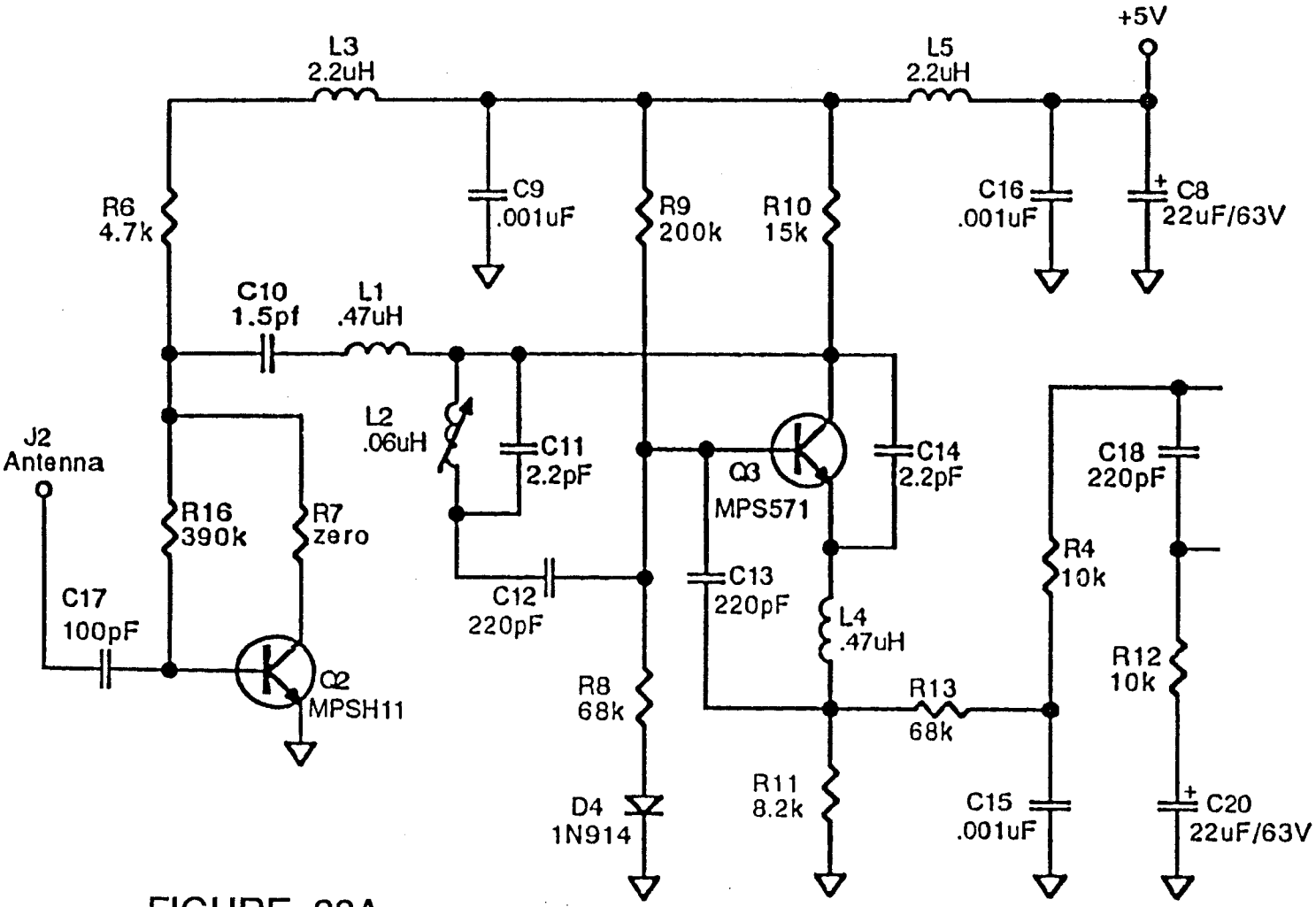
FIGS. 28A, 28B, 29, 30A, 30B, 31A, 31B, 32A, 32B, 33A and 33B are collectively details of the control broad of FIG. 27, with FIG. 28A and 28B representing the radio frequency portion thereof, FIG. 29 representing the PS portion thereof, FIG. 30A and 30B and 31A and 31B representing the relays portion thereof, FIG. 32A and 32B representing the decoder portion thereof, and FIG. 33A and 33B representing the inputs portions thereof.
Figure 28B:
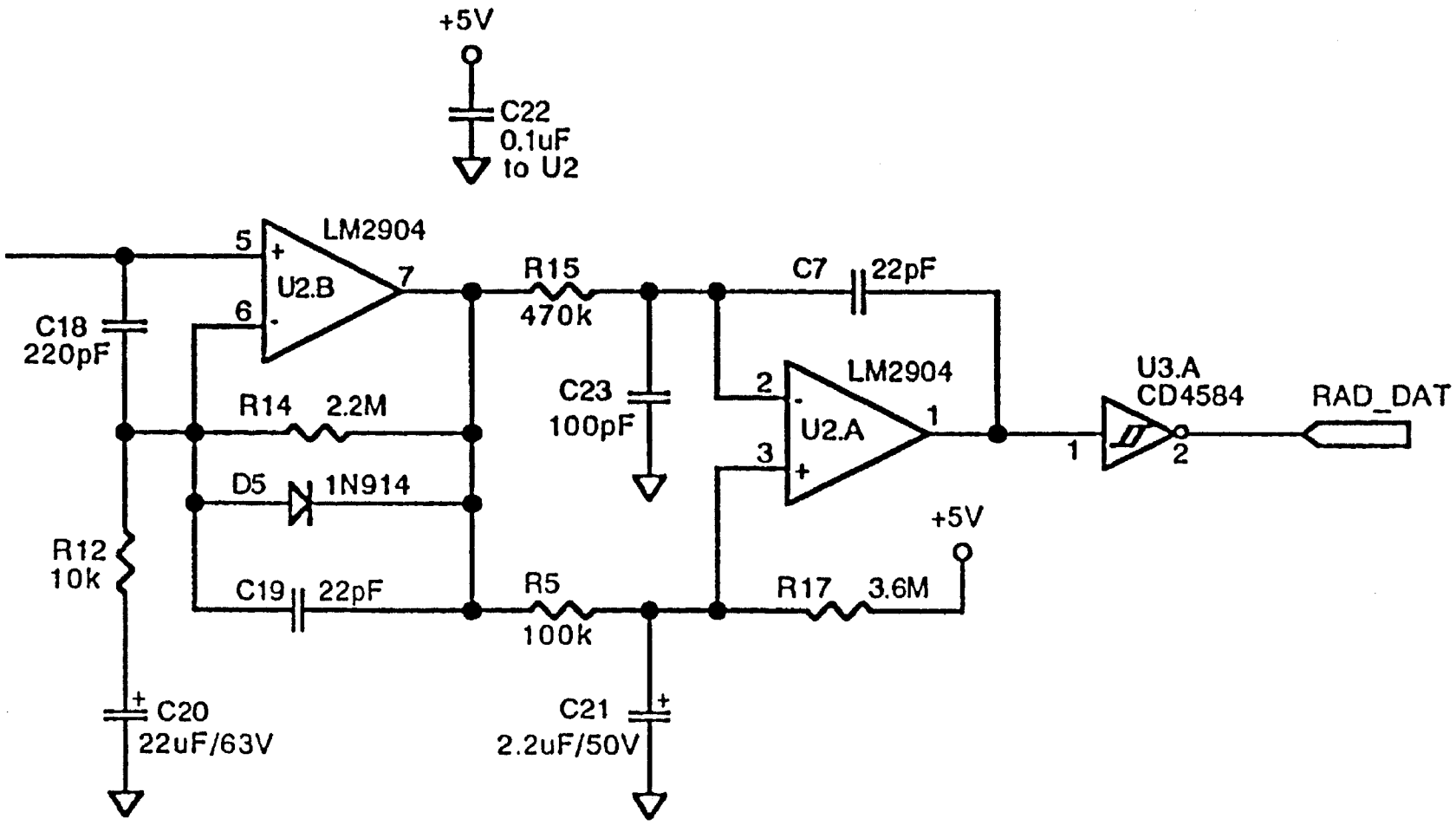
Figure 29:
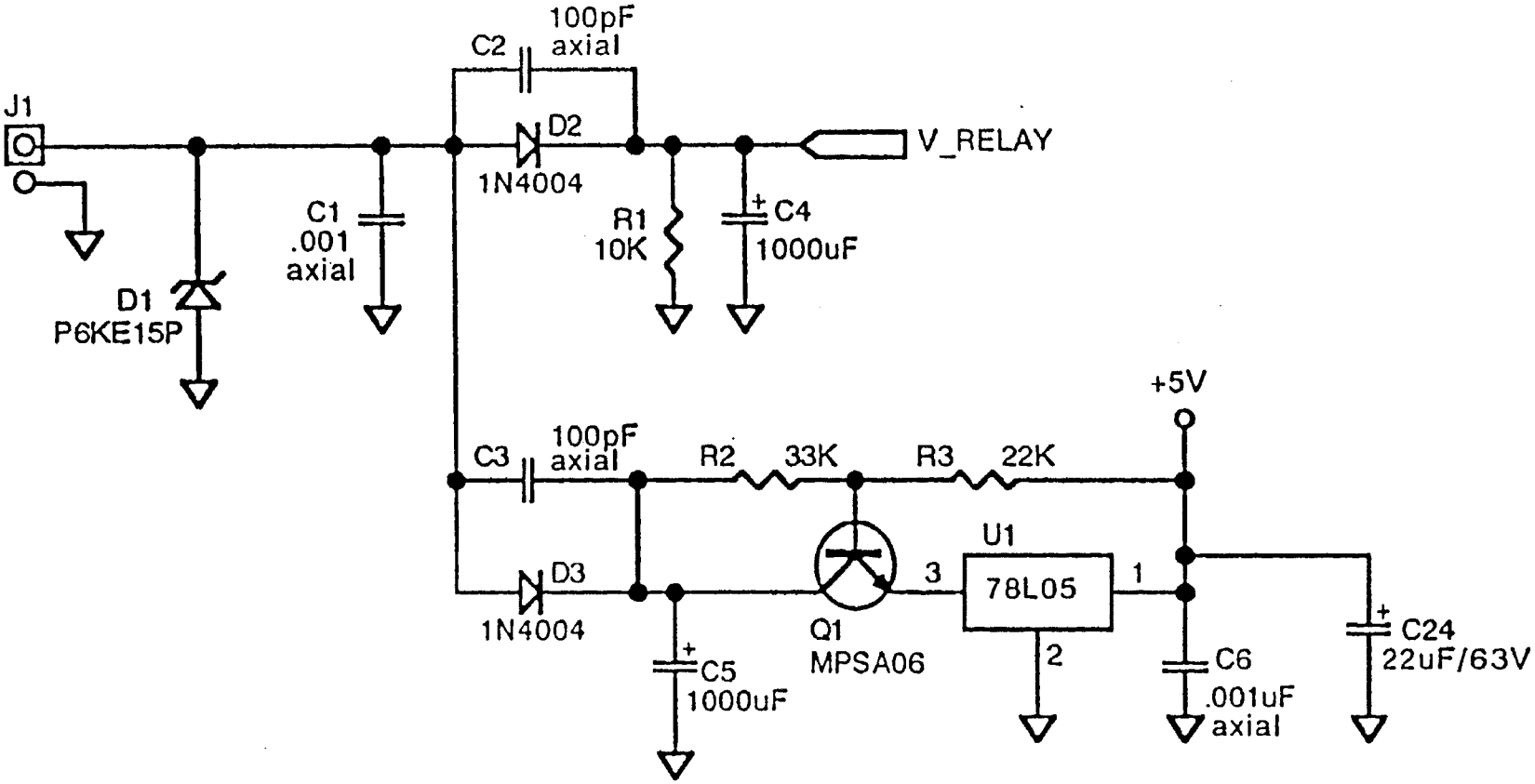
Figure 30A:
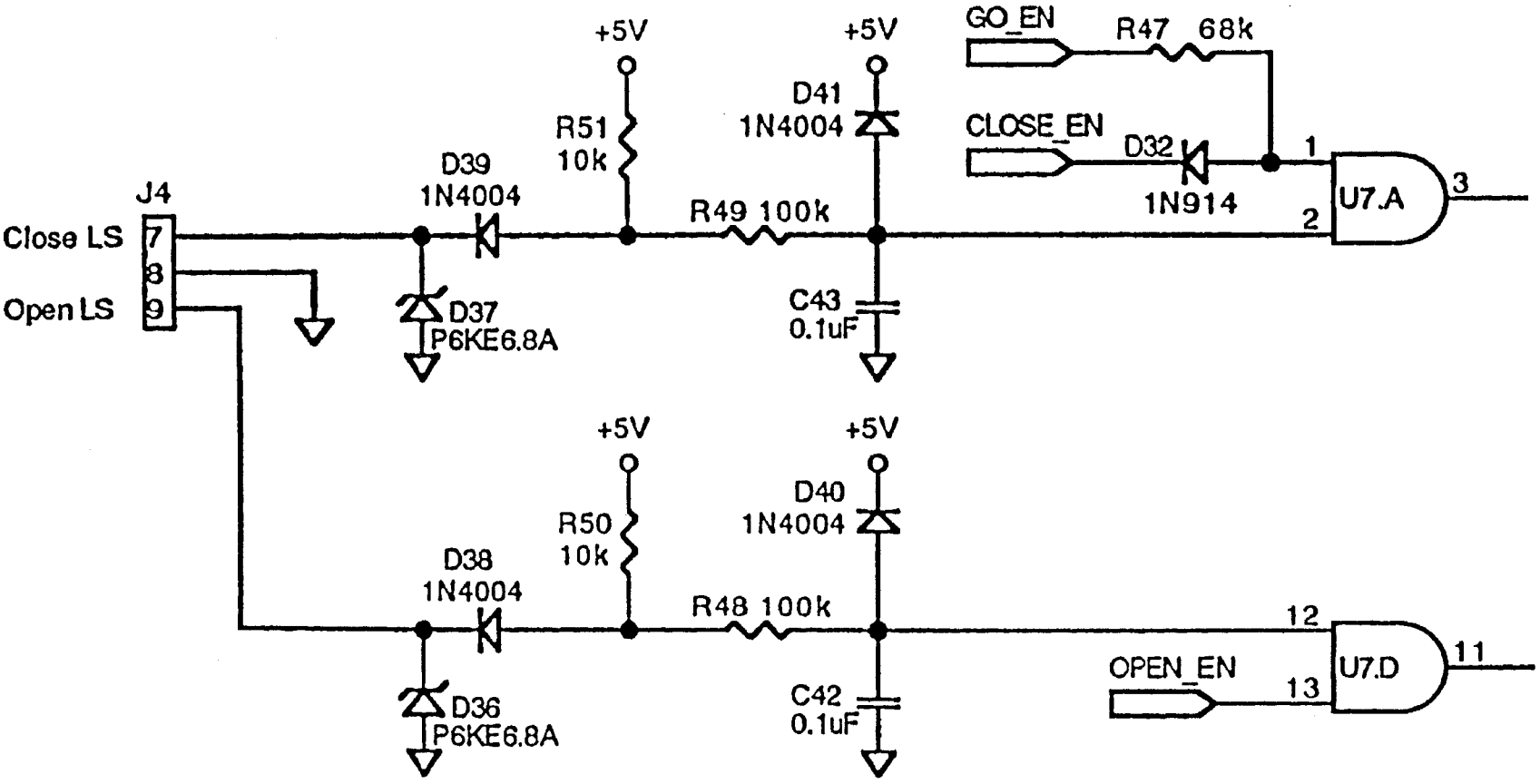
Figure 30B:
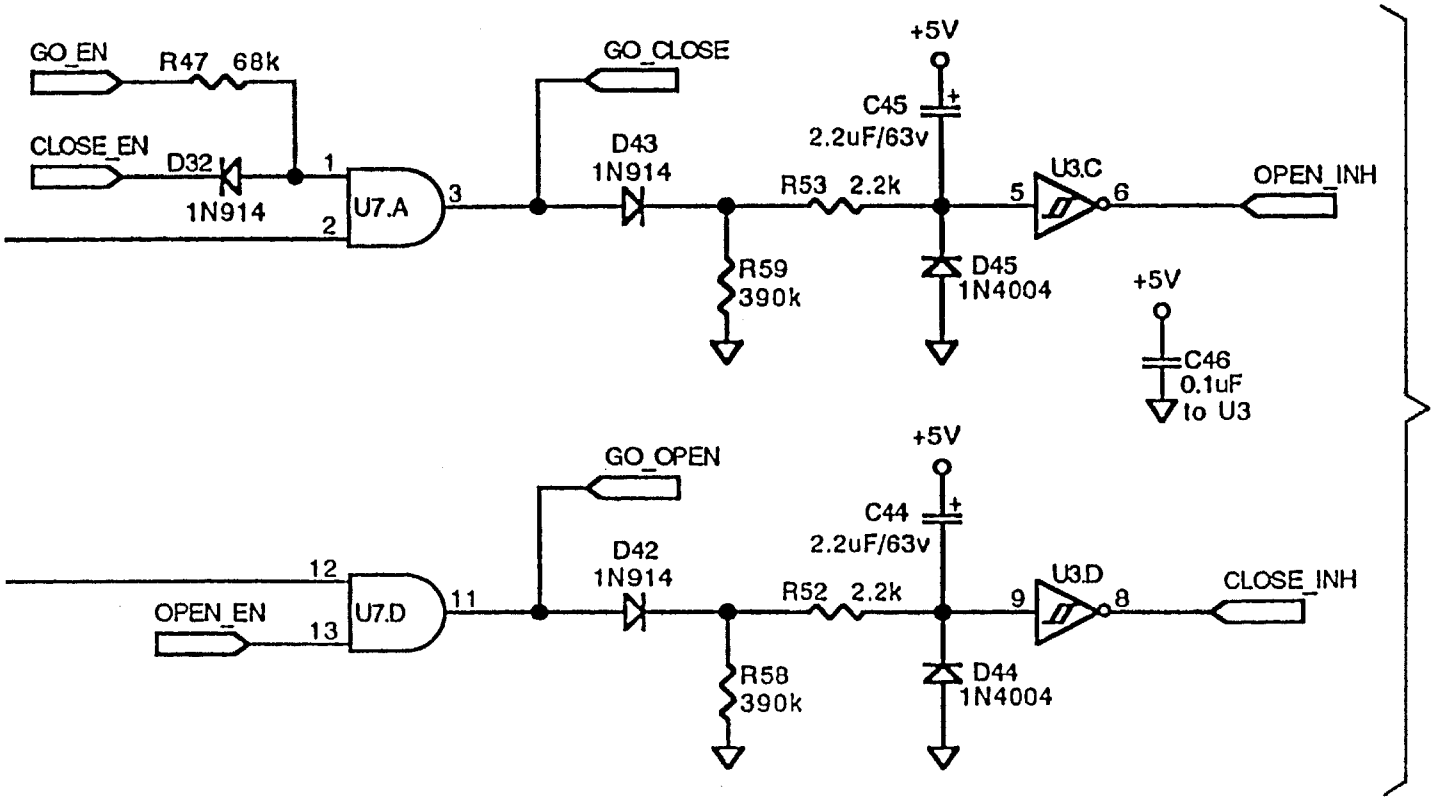
Figure 31A:
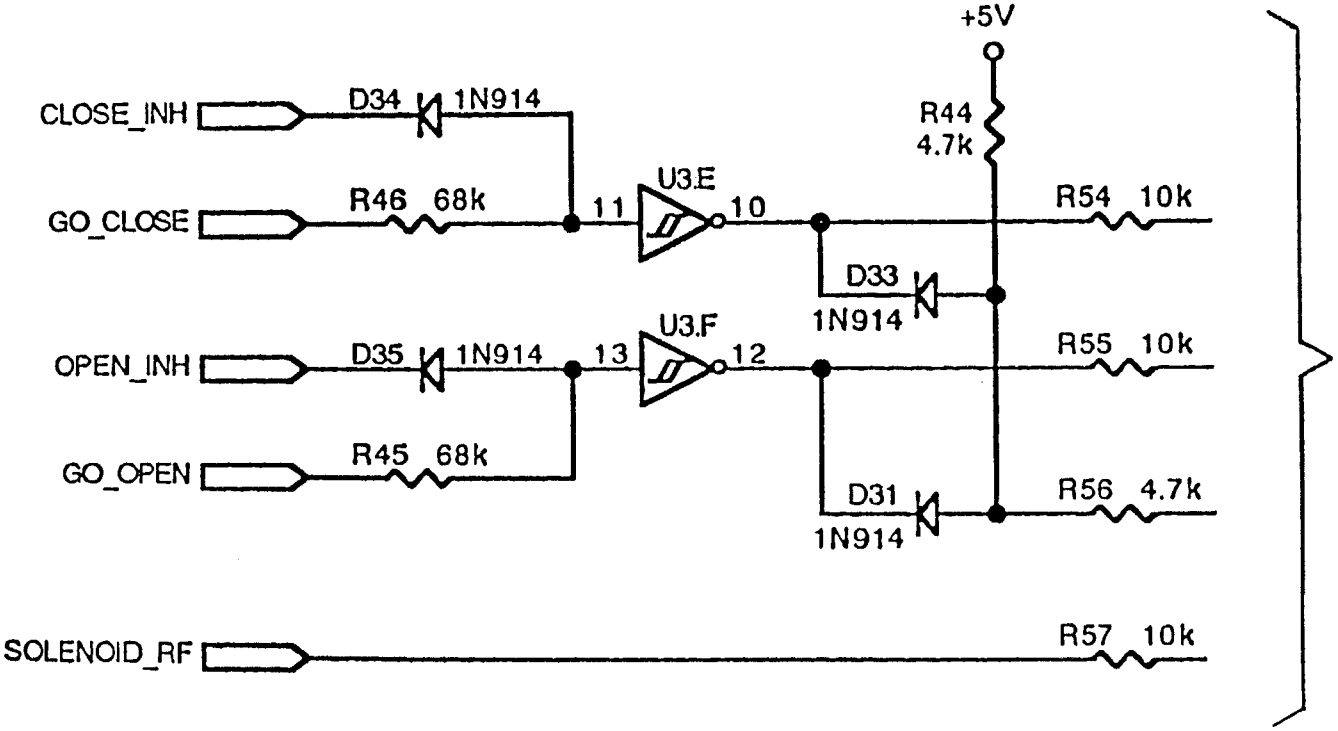
Figure 31B:
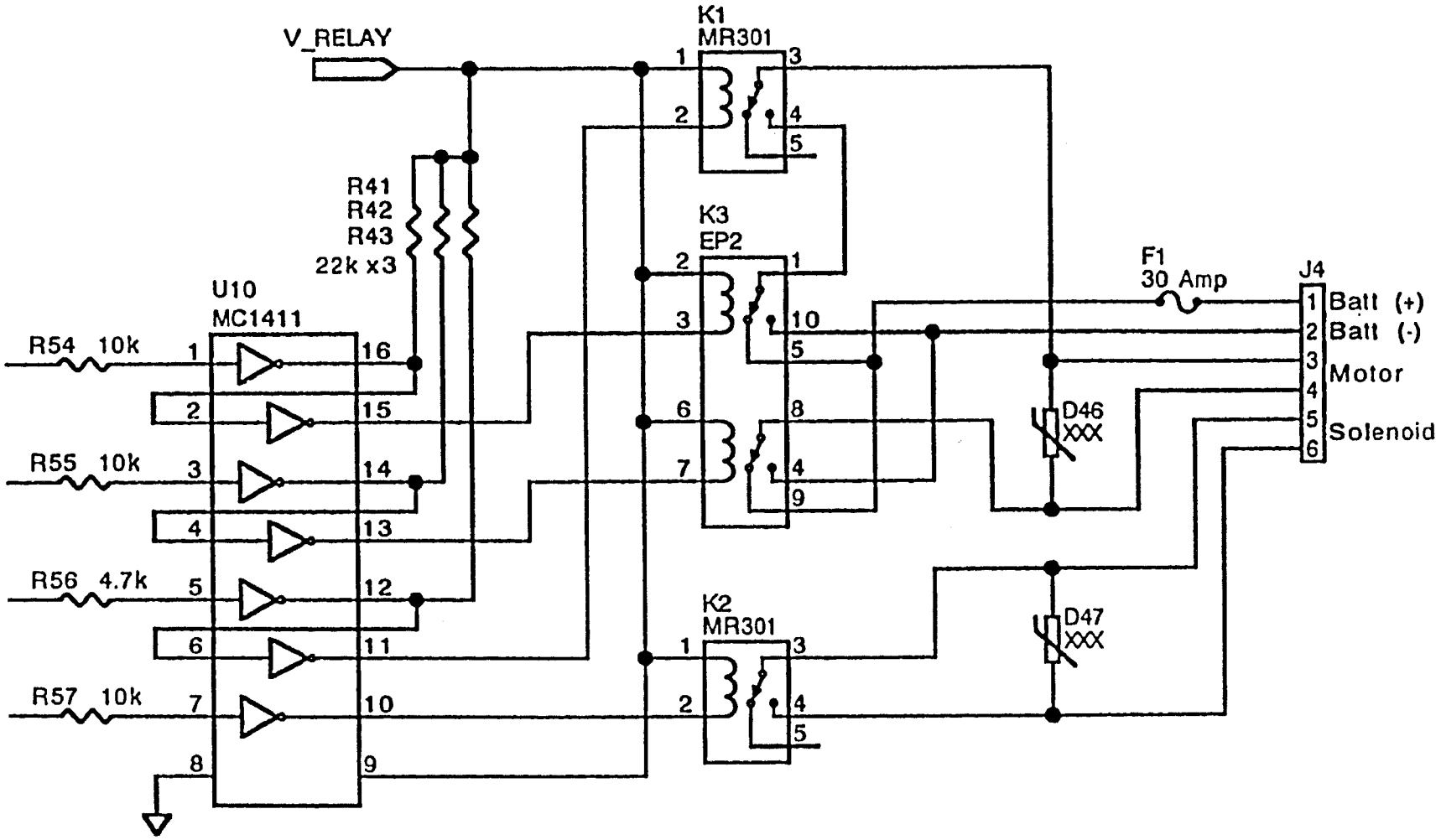
Figure 32A:
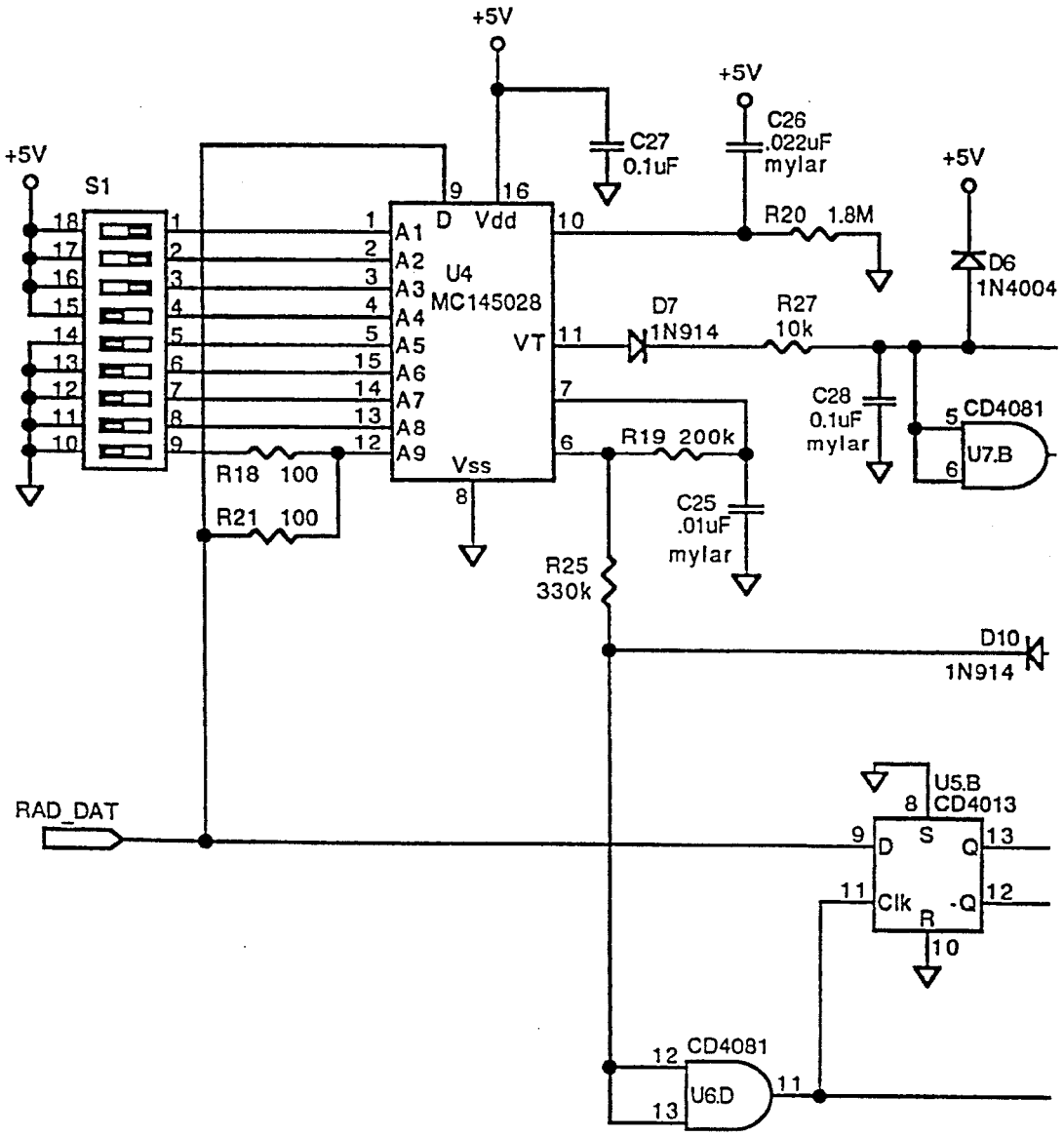
Figure 32B:
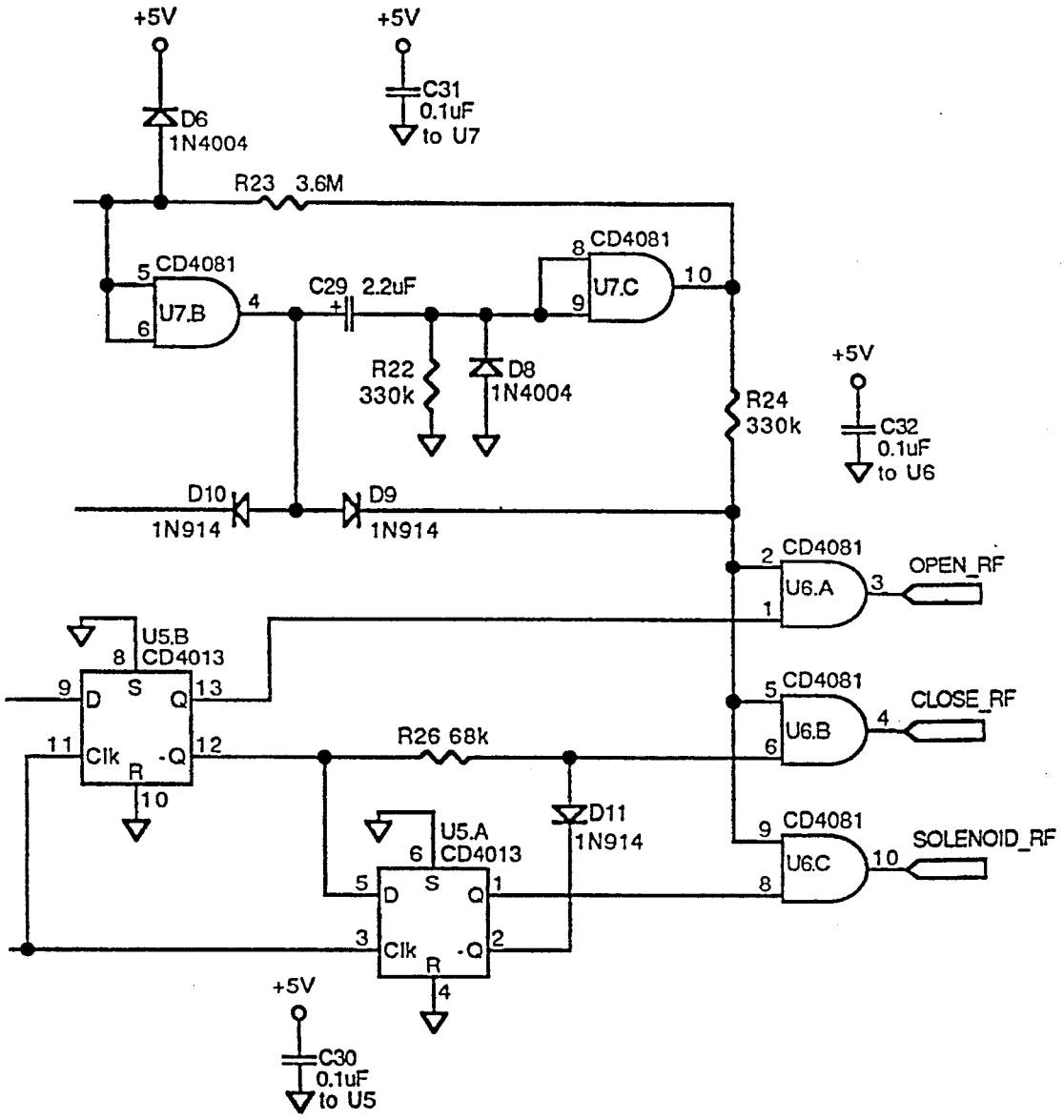
Figure 33A:
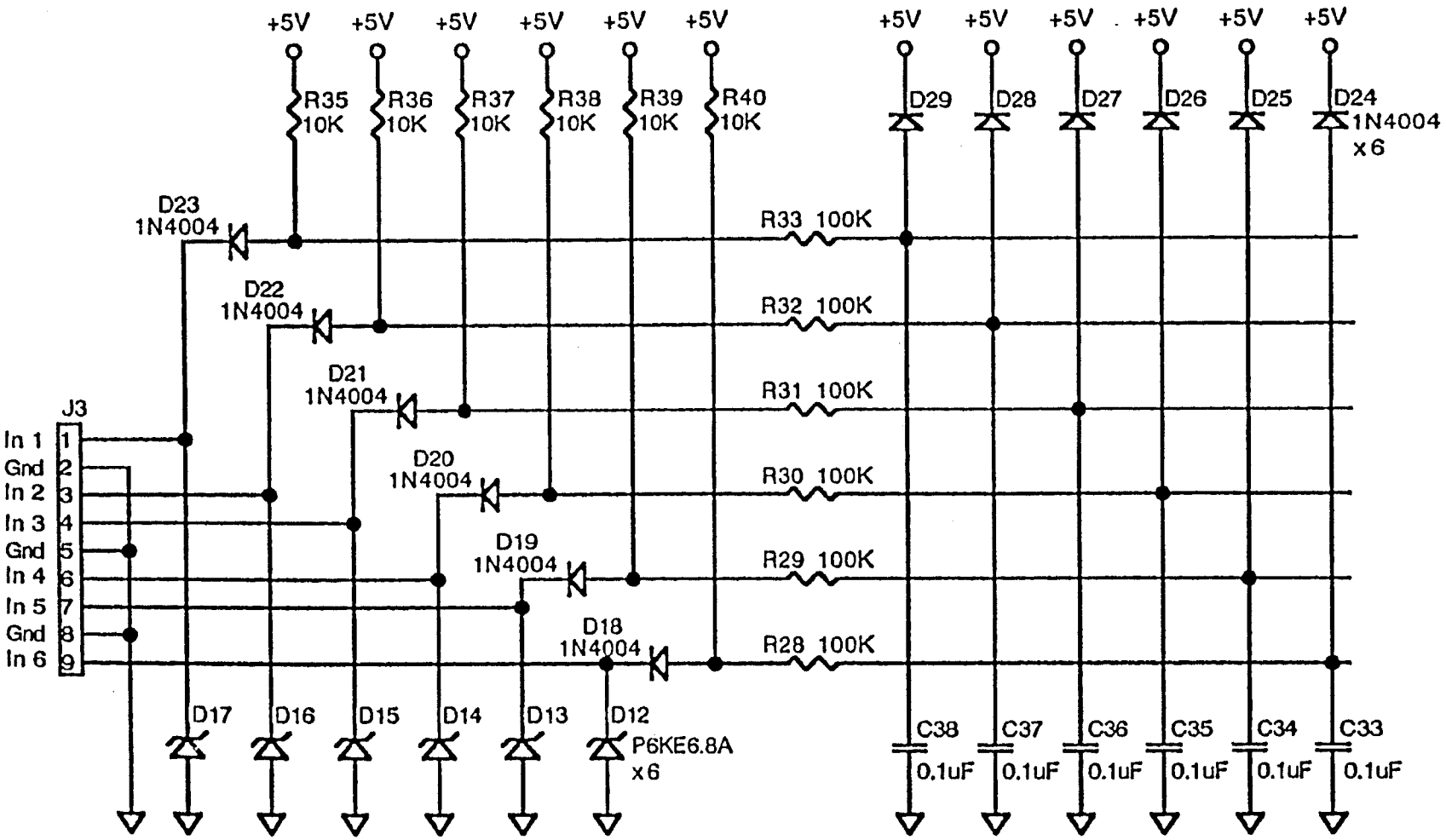
Figure 33B:
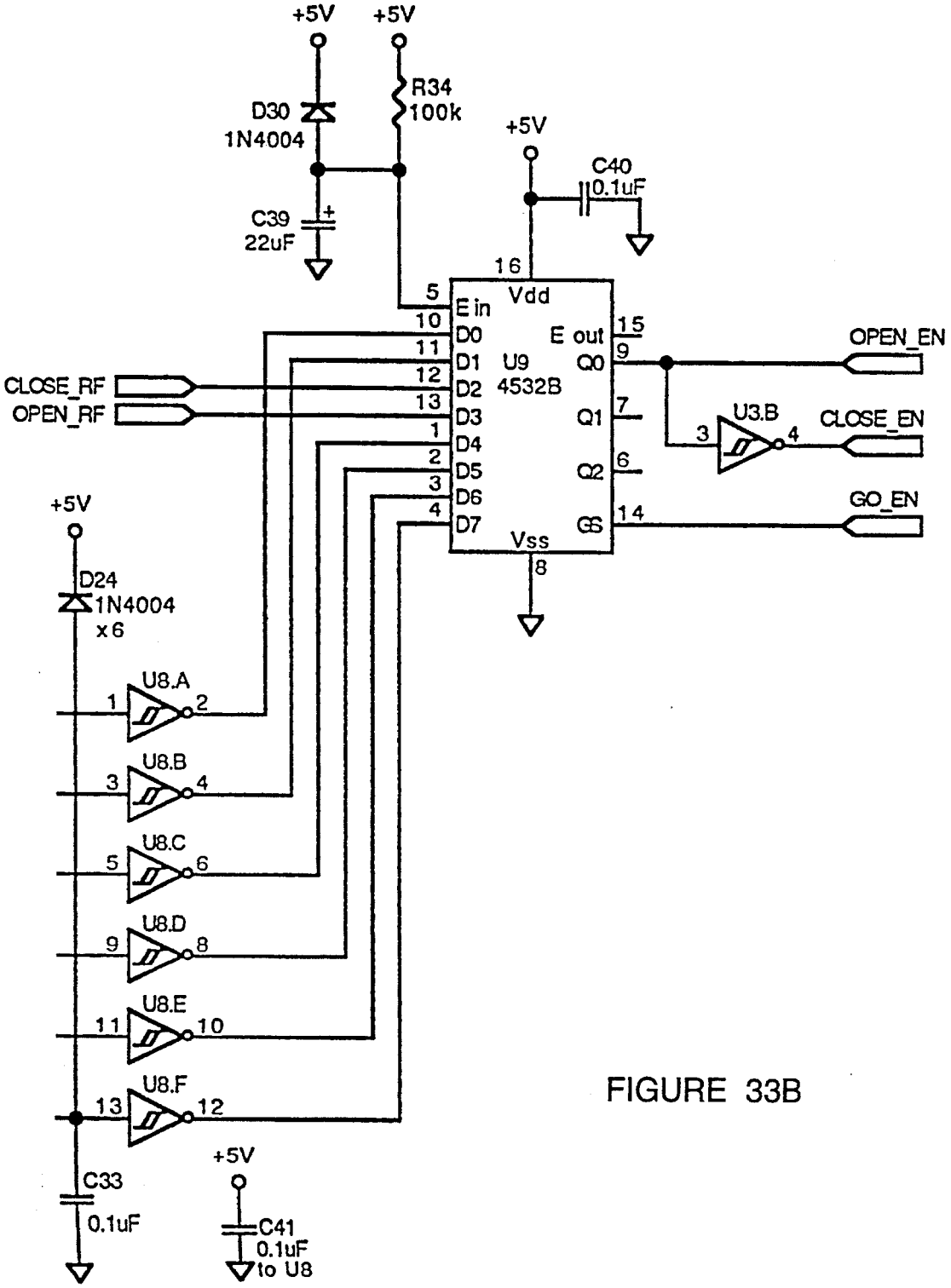

More specific block diagrams for the transmitter and controller are shown in FIGS. 26 and 27. Greater details of these circuits are shown on FIGS. 28A, 28B, 29, 30A, 30B, 31A, 31B, 32A, 32B, 33A and 33B. A portion of FIG. 28A is repeated in FIG. 28B to show how the circuit of FIG. 28A is continued in FIG. 28B. A similar relationship exists for FIGS. 30A and 30B, FIGS. 31A and 31B, FIGS. 32A and 32B, and FIGS. 33A and 33B.

The following abbreviations are used:

| RF | Radio frequency |
|---|---|
| CLOSE_EN | Enable to close |
| CLOSE_INH | Inhibit to close |
| CLOSE_RF | Close signal originating from the RF source |
| GO_CLOSE | Go close |
| GO_EN | Enable to go |
| GO_OPEN | Go open |
| OPEN_EN | Enable to open |
| OPEN_INH | Inhibit to open |
| OPEN_RF | Open signal originating from the RF source |
| RAD_DAT | Data originating from a transmitter and processed by the radio receiver |
| SOLENOID_RF | Solenoid operate signal, originating from the RF source |
| V_RELAY | Un-regulated supply voltage source for the relays |

-continued

| RF | Radio frequency |
|---|---|
| C | Capacitor |
| D | Diode |
| K | Relay |
| J | Terminal strip, connection point to devices not on the printed circuit board |
| L | Inductor |
| LS | Limit switch |
| R | Resistor |

The system consist of a three button transmitter 239 and control board 233. Referring to FIGS. 26 and 27, when any one of the transmitter buttons, 240, 241 and 242, is pressed the encoder chip, in Encoder 290, reads the 8 pole 3 position switch, determines which push button was pressed, and then generates a digital sequence of eighteen (18) pulses to modulate the radio frequency ("RE"). Sixteen (16) of the digital pulses are determined by the 8 pole 3 position switch, and two (2) pulses are determined by the particular transmitter button is pressed. The generated signal from the RF Section 251 is then be radiated from antenna 252 of transmitter 239 to receiver 243 Encoder Section 250 and RF Section 251 are powered by 9v DC source 29:3.

Control board power, 12 volts DC from battery 231 is supplied through a pair of wires attached to terminal strip leads J1-1 and J1-2. This voltage is fed through diode D2 to supply unregulated voltage to the relay coil. This voltage is also fed through diode D3 to pre-regulator Q1 and then into regulator U1 to provide regulated 5 DC voltage for operation of the remainder of the circuit, i.e. RF Section 260, Decoder 261, Inputs 262, and Relays 263. The normal sequence of events is as follows. The antenna 264 receives the transmitted signal that the transmitter 239 has sent. When the superegenerative receive of RF Section 260 is tuned to that frequency by L2, typically 318 MHz, Q3 in conjunction with the associated components extracts the digital information from the RE signal. This information is then Passed on to the amplifier section for additional amplification by U2:A and U2:B to a level suitable for handing by the integrated circuits on the board. The received and amplified signal is then sent to the Decoder 261 (U4) where it is compared with S1, an 8 pole 3 position DIP switch, for number of pulses, spacing of pulses, spacing between pulses, and spacing between burst of pulses, also referred to as dead time. Included in the decoder section is logic to determine which button of the transmitter was pressed, i.e. button 240, 241 or 242. This decoding will cause the appropriate output of U6:A, U6:B, U6:C, to be high when the appropriate button is pressed. Button 240 equals OPEN_RF, Button 241 equals CLOSE_RF, and Button 241 equals SOLENOID_RF.

SOLENOID_RE is directed to U10, relay driver integrated circuit (Relays 263), which controls relay K2. K2 relay contacts are connected to terminal strip J4 terminals 5 and 6 to wires are attached for control of the solenoid when button 2 the transmitter is pressed.

OPEN_RF and CLOSE_RE are directed to (Inputs 262) priority integrated circuit U9 that functions as a selector for OPEN_EN, CLOSE_EN, GO_EN. Priority of the inputs is established by which terminal an input is wired to, In all cases priority 1 overrides all other inputs, likewise priority 3 overrides all priorities lower than 3, but does not override priority 1, or priority 2. An example of priority selection is as follows.

| Input | Priority | Type Input | Comments |
|---|---|---|---|
| J3 pin 9 | 1 | Open | When smoke detected |
| J3 pin 7 | 2 | Close | When moisture detected |
| J3 pin 6 | 3 | Open | Optional purpose |
| J3 pin 4 | 4 | Close | When motion detected |
| OPEN_RF | 5 | Open | Transmitter Button 240 |
| CLOSE_RF | 6 | Close | Transmitter Button 241 |
| J3 pin 3 | 7 | Open | Optional purpose |
| J3 pin 1 | 8 | Close | Optional purpose |

When OPEN_EN is high, and there is not a switch closure on the Open LS Input J4-9, then GO_OPEN will be high. GO_OPEN is directed to U10, relay driver (Relays 263) and will cause the open relay K3 contacts to close and at the same time relay K1 closes, thereby providing power to the contacts of relay K3. This provides power to the motor 244 in the open direction. When ON_OPEN is high, then CLOSE_INH will be low, thereby keeping U3:E from going high, and keeping the close relay of K3 from operating.

When CLOSE_EN is high and there is not a switch closure on the Close LS Input J4-7, GO_CLOSE will be high which is directed to U10, relay driver (Relays 263), and this causes the close relay of K3 contacts to close, at the same time relay K1 closes providing power to the contacts of relay K3, thereby providing power to the motor 244 in the close direction. When GO_CLOSE is high, then OPEN_INH is low, thereby keeping U3:F from going high and keeping the open relay of KS from operating.

The OPEN_INH and CLOSE_INH change of states are delayed after the GO_OPEN and GO_CLOSE signals cease. This allows time for the motor 244 to stop before reversing. If this feature is not present and a higher priority signal occurs, motor 244 could require an instantaneous reversal, possibly damaging the motor and or mechanical members of the apparatus.

The following components should be non-magnetic, preferably an aluminum alloy to avoid interference with solenoid 160, U-bar 127, angle member 150, lever 152 and four flange bracket 158. The parallel tracks 42 and 43, and the shelves for solar pane. 230, battery 231 and controller 233 are also preferably aluminum. Skylight and self flashing suitable for functioning as a carriage are usually aluminum or stainless steel with glass or plexiglass panels.

With regard to specific recommendations, a non-limiting example of a linear actuator in Thomson Saginaw part no. 7871180 having a 36 inch at stroke. A non-limiting example of a solar panel is Model MA-5 solar panel from Sun Flex. A non-limiting example of a battery is a sealed rechargeable lead-acid battery NP7-12, 12v, 7.0 amp from Yuasa-Exide. A non-limiting example of a solenoid is a type 11P CONT 12v solenoid from Guardian Electric Manufacturing Co. A non-limiting example of a flexible screen is a solar-insect type capable of screening out up to about 70% of sun's rays. A non-limiting example of a transmitter is a Pulsar model 833 triple channel transmitter. A non-limiting example of a motion detector is a Model 49-640 Mobile Alert from Radio Shack. A non-limiting example of a moisture detector in a Model WB-200 from Waterbug. A non-limiting example of a smoke detector is a Model 4S1T, 445CS Series gas and smoke detector from Macurco Inc. Since any type flexible shade can be used, no recommendation is offered. The diameter of the shade roller is preferably about 1.0 inch and the screen roller about 0.75 inch. Framing 44 is generally wood except for aluminum square channel 61. Channel 61 is optional and the framing can be made entirely of wood if desired.

While the preferred embodiments of the present invention have been described, it should be understood that various changes, adaptations and modifications may be made thereto without departing from the spirit of the invention and the scope of the appended claims. It should be understood, therefore, that the invention is not to be limited to minor details of the illustrated invention shown in preferred embodiment and the figures, and that variations in such minor details will be apparent to one skilled in the art.

Therefore it is to be understood that the present disclosure and embodiments of this invention described herein are for purposes of illustration and example and that modifications and improvements may be made thereto without departing from the spirit of the invention or from the scope of the claims. The claims, therefore, are to be accorded a range of equivalents commensurate in scope with the advances made over the art.

What is claimed is:

1. An apparatus for covering and uncovering an opening in a structure comprising:

a framing having front, rear, left and right side members with an opening therethrough which spans an opening in a structure;

a pair of parallel guides each having a left end, a right end and a length, one of the guide mounted on an outside surface of the front side member of the framing and the other guide mounted on an outside surface of the rear side member of the framing, the left end of each of the parallel guides being near the left side member of the framing and the right end of each of the guides extending beyond the right side member of the framing a predetermined distance;

carriage means movably mounted on the parallel guides so that the carriage means can be moved over the length of the parallel guides, the carriage means having an opening therethrough about the same size as the opening through the framing, the carriage means adaptable for mounting a cover member thereon;

means for moving the carriage means over the length of the parallel guides;

a flexible screen having a size large enough to cover the opening through the framing, the screen having one end thereof connected to the left side of the carriage means;

screen storage means for rolling the other end of the screen onto for storage, the screen storage means rotatably supported by a stationary member at a location near and outside of the left side member of the framing; and means for maintaining the screen in tension so that, when the carriage means is displaced away from the left side member of the framing, the screen will be unrolled from the screen storage means and tautly pulled over a space between the left side member of the framing rood the left side of the carriage means.

2. The apparatus of claim 1, further comprising a cover member mounted on the carriage means.

3. The apparatus of claim 2, wherein the cover member is a skylights.

4. The apparatus of claim 1, further comprising means for aligning the screen to the framing as the screen is tautly pulled over the space between the left side member of the framing and the left side of the carriage means.

5. The apparatus of claim 1, further comprising:

a shade having a size large enough to cover the opening through the carriage means;

shade storage means for storing the shade away from the opening through the framing; and means for linking and unlinking the shade to the carriage means so that, when the shade is linked to the carriage means, that part of the opening through the carriage mean between the left end of the opening through the carriage means and the right side member of the framing is covered by the shade.

6. The apparatus of claim 1, further comprising:

a flexible shade having a size large enough to cover the opening through the carriage means;

shade storage means for rolling the shade onto for storage, the shade storage means rotatably supported by a stationary member at a location near and outside of the right side member of the framing;

means for linking and unlinking one end of the shade to the carriage means so that, when said one end of the shade is linked to the carriage means, that part of the opening through the carriage mean between the left end of the opening through the carriage means, and the right side member of the framing is covered by the shade; and means for maintaining the shade in tension between the shade storage means and said one end of the shade so that, when said one end of the shade is linked to the carriage means, the shade will be unrolled from the shade storage means and tautly pulled over said part of the opening through the carriage mean.

7. The apparatus of claim 1, wherein the means for moving the carriage means comprises a linear actuator, housing of which is mounted to a stationary member and a telescoping member of which is connected to the carriage means.

8. The apparatus of claim 1, further comprising controller means having a first control for moving the carriage means towards the left end of the parallel guides, and a second control for moving the carriage means towards the right end of the parallel guides.

9. The apparatus of claim 8, wherein the controller means is a remote controlled controller means.

10. The apparatus of claim 1, further comprising means for automatically stopping the carriage means as it moves towards the left end of the parallel guides and completely covers the opening through the framing, and means for automatically stopping the carriage means as it moves towards and reaches a predetermined point near the right end of the parallel guides.

11. The apparatus of claim 1, further comprising means for sensing smoke at a predetermined location inside the structure and, when smoke is sensed, for automatically moving the carriage means to a predetermined point near the right end of the parallel guides.

12. The apparatus of claim 1, further comprising means for sensing moisture at a predetermined location outside of the structure and, when moisture is sensed, for automatically moving the carriage means over the opening through the framing.

13. The apparatus of claim 1, further comprising means for sensing motion at a predetermined location outside of the structure and, when motion is sensed, for automatically moving the carriage means over the opening through the framing.

14. An apparatus for covering and uncovering an opening in a structure comprising:

a framing having front, rear, left and right side members with an opening therethrough which spans an opening in a structure;

a pair of parallel guides each having a left end, a right end and a length, one of the guide mounted on an outside surface of the front side member of the framing and the other guide mounted on an outside surface of the rear side member of the framing, the left end of each of the parallel guides being near the left side member of the framing and the right end of each of the guides extending beyond the right side member of the framing a predetermined distance;

carriage means movably mounted on the parallel guides so that the carriage means can be moved over the length of the parallel guides, the carriage means having an opening therethrough about the same size as the opening through the framing, the carriage means adaptable for mounting a cover member thereon;

means for moving the carriage means over the length of the parallel guides;

a flexible shade having a size large enough to cover the opening through the carriage means;

shade storage means for rolling the shade onto for storage, the shade storage means rotatably supported by a stationary member at a location near and outside of the right side member of the framing;

means for linking and unlinking one end of the shade to the carriage means so that, when said one end of the shade is linked to the carriage means, that part of the opening through the carriage mean between the left end of the opening through the carriage means and the right side member of the framing is covered by the shade; and means for maintaining the shade in tension between the shade storage means and said one end of the shade so that, when said one end of the shade is linked to the carriage means, the shade will be unrolled from the shade storage means and tautly pulled over said part of the opening through the carriage mean.

15. The apparatus of claim 14, further comprising an elongated roller means supported by a stationary member and positioned between the shade storage means and said one end of the shade, the elongated roller means for aligning the shade over the right side member of the framing as the shade is extended thereover.

16. The apparatus, of claim 14, further comprising controller means having a first control for moving the carriage means towards the left end of the parallel guides, a second control for moving the carriages means towards the right end of the parallel guides, and a third control for activating and deactivating the means for linking and unlinking said one end of the shade to the carriage means.

17. The apparatus of claim 14, wherein the means for linking and unlinking said one end of the shade to the carriage means comprises:

spanner member having left and right ends the left end connected to said one end of the flexible shade; and means, for coupling and uncoupling the right end of the spanner member to the right side of the carriage means, and wherein, when the spanner member is coupled to the right side of the carriage means, the left end of the spanner member is positioned near the left side of the opening through the carriage means.

18. The apparatus of claim 17, wherein, when the spanner member is coupled to the carriage means, the spanner member is between the flexible shade and the carriage means.

19. The apparatus of claim 17, further comprising a cross member fixed to and spanning from front to rear the right end of the parallel guides;

wherein the means for coupling and uncoupling the right end of the spanner member to the right side of the carriage means comprises solenoid means and connector means having a first part and a second part, the solenoid means having a plunger, the solenoid means supported by the cross member, the first part having a first-half connector link, the first part supported by the right distal end of the spanner member, the second part having a cam part and a second-half connector link, the second part pivotally connected to the right side of the carriage means, wherein, when the plunger of solenoid means is retracted, the second-half connector link connects to the first-half connector link when the carriage means reaches the solenoid means, wherein, when the first-half and second-half connector links are connected and the plunger of solenoid means is extended, the extend plunger and cam part cause the second part to pivot away from the first-half connector link when the cam part reaches the solenoid means thereby disconnecting of the second-half connector link from the first-half connector link, and wherein, when the first-half and second-half connector links are disconnected and the plunger of solenoid means is extended, the extended plunger and cam part cause the second part to pivot away from the first-half connector link when the cam part reaches the solenoid means thereby preventing the second-half connector link from connecting to the first-half connector link.

20. The apparatus of claim 19, further comprising controller means having a first control for moving the carriage means towards the left end of the parallel guides, a second control for moving the carriage means towards the right end of the parallel guides, and a third control for energizing the solenoid means.

21. An apparatus for covering and uncovering an opening in a structure comprising:

a framing having front, rear, left and right side members with an opening therethrough which spans an opening in a structure;

a pair of parallel guides each having a left end, a right end and a length, one of the guide mounted on an outside surface of the front side member of the framing and the other guide mounted on an outside surface of the rear side member of the framing, the left end of each of the parallel guides being near the left side member of the framing and the right end of each of the guides extending beyond the right side member of the framing a predetermined distance;

carriage means movably mounted on the parallel guides so that the carriage means can be moved over the length of the parallel guides, the carriage means having an opening therethrough about the same size as the opening through the framing, the carriage means adaptable for mounting a cover member thereon;

means for moving the carriage means over the length of the parallel guides;

a rigid tray member having front, rear, left and rights ends and an opening therebetween, the tray member having a size large enough to span the opening through the carriage means;

a panel member fitted over the opening of, and encased by, the tray member;

means for coupling and uncoupling the right side of the tray member to the right side of the carriage means so that, when the tray member is so coupled, the left side of the tray member is positioned near the left side of the opening through the carriage means, and the part of the opening through the framing covered by the carriage means is also covered by the tray member and panel member assembly.

22. The apparatus of claim 21, wherein the opening through the tray member is a plurality of openings formed by a frame work dependent from the tray member, and wherein the panel member is a plurality of panels fitted over the plurality of openings in the frame work.

23. The apparatus of claim 21, further comprising a cross member fixed to and spanning from front to rear the right end of the parallel guides;

wherein the means for coupling and uncoupling the right side of the tray member to the right side of the carriage means comprises solenoid means and connector means having a first part and a second part, the solenoid means having a plunger, the solenoid means supported by the cross member, the first part having a first-half connector link, the first part supported by the right end of the tray member, the second part having a cam part and second-half connector link, the second part pivotally connected to the right side of the carriage means, wherein, when the plunger of solenoid means is retracted, the second-halt connector link connects to the first-half connector link when the carriage means reaches the solenoid means, wherein when the first-half and second-half connector links are connected and the plunger of solenoid means is extended, the extended plunger and cam part cause the second part to pivot away from the first-half connector link when the cam part reaches the solenoid means thereby disconnecting of the second-half connector link from the first-half connector link, and wherein, when the first-half and second-half connector links are disconnected and the plunger of solenoid means is extended, the extended plunger and cam part cause the second part to pivot away from the first-half connector link when the cam part reaches the solenoid means thereby preventing the second-half connector link from connecting to the first-half connector link.

24. An apparatus for covering and uncovering an opening in a structure comprising:

a framing having front, rear, left and right side members with which opening therethrough which spans an opening in a structure;

a pair of parallel guides each having a left end, a right end and a length, one of the guide mounted on an outside surface of the front side member of the framing and the other guide mounted on an outside surface of the rear side member of the framing, the left end of each of the parallel guides being near the left side member of the framing and the right end of each of the guides extending beyond the right side member of the framing a predetermined distance;

carriage means movably mounted on the parallel guides so that the carriage means can be moved over the length of the parallel guides, the carriage means having an opening therethrough about the same size as the opening through the framing, the carriage means adaptable for mounting a cover member thereon; and means for moving the carriage means over the length of the parallel guides which comprises a linear actuator the housing of which is mounted to a stationary member and a telescoping member of which is connected to the carriage means.

25. The apparatus of claim 24, further comprising means for automatically stopping the carriage means as it moves towards the left end of the parallel guides and completely covers the opening through the framing, and means for automatically stopping the carriage means as it moves towards and reaches a predetermined point near the right end of the parallel guides.

26. The apparatus of claim 24, further comprising an electrical power source for powering the linear actuator.

27. The apparatus of claim 26, wherein the electrical power source is a battery.

28. The apparatus of claim 27, further comprising a solar panel for charging the battery.

29. An apparatus for covering and uncovering an opening in a structure comprising:

a framing having front, rear, left and right side members with an opening therethrough which spans an opening in a structure;

a pair of parallel guides each having a left end, a right end and a length, one of the guide mounted on an outside surface of the front side member of the framing and the other guide mounted on an outside surface of the rear side member of the framing, the left end of each of the parallel guides being near the left side member of the framing and the right end of each of the guides extending beyond the right side member of the framing predetermined distance;

carriage means movably mounted on the parallel guides so that the carriage means can be moved over the length of the parallel guides, the carriage means having an opening therethrough about the same size as the opening through the framing, the carriage means adaptable for mounting a cover member thereon;

means for moving the carriage means over the length of the parallel guides; and smoke detector means for sensing smoke at a predetermined location in the structure and, when smoke is sensed, for automatically moving the carriage means to a predetermined point near the right end of the parallel guides.

30. The apparatus of claim 29, further comprising an alarm for emitting a continuous warning sound when the smoke detector means senses smoke.

31. The apparatus of claim 29, further comprising moisture detector means for sensing moisture at a predetermined location outside of the structure and, when moisture is sensed, for automatically moving the carriage means over the opening through the framing.

32. The apparatus of claim 29, further comprising motion detector means for sensing motion at a predetermined location outside of the structure and, when motion is sensed, for automatically moving the carriage means over the opening through the framing.

33. The apparatus of the claim 32, further comprising an alarm for emitting a continuous warning sound when the motion detector means senses motion.

34. The apparatus of claim 9, wherein the remote control means is voice activated.

* * * * *